US008180229B2

(12) United States Patent
Kawaguchi

(10) Patent No.: US 8,180,229 B2
(45) Date of Patent: May 15, 2012

(54) APPARATUS AND METHOD OF CONTROLLING INTERCHANGE BETWEEN COMPONENT PARTS IN THE APPARATUS

(75) Inventor: Tadashi Kawaguchi, Tokyo (JP)

(73) Assignee: Canon Kabushiki Kaisha (JP)

( * ) Notice: Subject to any disclaimer, the term of this patent is extended or adjusted under 35 U.S.C. 154(b) by 427 days.

(21) Appl. No.: 12/463,263

(22) Filed: May 8, 2009

(65) Prior Publication Data

US 2009/0285586 A1 Nov. 19, 2009

(30) Foreign Application Priority Data

May 15, 2008 (JP) ..... 2008-128316

(51) Int. Cl.
*G03G 15/00* (2006.01)

(52) U.S. Cl. ..... 399/12; 399/13

(58) Field of Classification Search ..... 399/12, 399/13

See application file for complete search history.

(56) References Cited

U.S. PATENT DOCUMENTS 6,883,797 B2 * 4/2005 Guddanti et al. ..... 271/122
7,664,408 B2 * 2/2010 Watanabe et al. ..... 399/12
2008/0298819 A1 * 12/2008 Ueda ..... 399/12

FOREIGN PATENT DOCUMENTS

JP 11-327381 A 11/1999
JP 2001-5351 A 1/2001

* cited by examiner

*Primary Examiner* — David Gray
*Assistant Examiner* — Frederick Wenderoth
(74) *Attorney, Agent, or Firm* — Rossi, Kimms & McDowell LLP

(57) ABSTRACT

An apparatus which is capable of substantially prolonging the service live of each component part and preventing the degradation of apparatus specifications before and after parts interchange work by the user. A controller of the image forming apparatus detects a component part requiring interchange from among the component parts based on wear ratios of the respective component parts. The controller determines whether or not to interchange the component part requiring interchange with another component part, based on the wear ratios of the respective component parts and usage rate of the respective component positions. When it is determined that the component part requiring interchange should be interchanged with another component part, the image forming apparatus issues a parts interchange notification.

8 Claims, 19 Drawing Sheets

| | | WEAR RATIO | THRESHOLD VALUE | USAGE RATE | THRESHOLD VALUE |
|---|---|---|---|---|---|
| SHEET FEEDER 1 | ROLLER UNIT A | 60 | 60 | 40 | 25 |
| SHEET FEEDER 2 | ROLLER UNIT B | 45 | 60 | 30 | 25 |
| SHEET FEEDER 3 | ROLLER UNIT C | 30 | 60 | 20 | 25 |
| SHEET FEEDER 4 | ROLLER UNIT D | 15 | 60 | 10 | 25 |

*FIG.8-1*

| | | WEAR RATIO | THRESHOLD VALUE | USAGE RATE | THRESHOLD VALUE |
|---|---|---|---|---|---|
| SHEET FEEDER 1 | ROLLER UNIT D | 15 | 60 | 40 | 25 |
| SHEET FEEDER 2 | ROLLER UNIT B | 45 | 60 | 30 | 25 |
| SHEET FEEDER 3 | ROLLER UNIT C | 30 | 60 | 20 | 25 |
| SHEET FEEDER 4 | ROLLER UNIT A | 60 | 90 | 10 | 25 |

*FIG.8-2*

| | | WEAR RATIO | THRESHOLD VALUE | USAGE RATE | THRESHOLD VALUE |
|---|---|---|---|---|---|
| SHEET FEEDER 1 | ROLLER UNIT B | 90 | 100 | 40 | 25 |
| SHEET FEEDER 2 | ROLLER UNIT A | 94 | 100 | 30 | 25 |
| SHEET FEEDER 3 | ROLLER UNIT D | 94 | 100 | 20 | 25 |
| SHEET FEEDER 4 | ROLLER UNIT C | 94 | 100 | 10 | 25 |

*FIG.8-9*

NO TARGET FOR INTERCHANGE EXISTS BECAUSE ALL ROLLER UNITS HAVE EXCEEDED THRESHOLD VALUE (90 IN THE PRESENT EXAMPLE) INDICATIVE OF EXPIRATION OF SERVICE LIFE

*FIG.8-10*

ISSUE NOTIFICATION RECOMMENDING REPLACEMENT OF ALL ROLLER UNITS OR INFORM SERVICE PERSON OF NEED TO REPLACE ALL ROLLER UNITS

*FIG.8-11*

*FIG.10-1*

| | | WEAR RATIO | THRESHOLD VALUE | USAGE RATE | THRESHOLD VALUE |
|---|---|---|---|---|---|
| SHEET FEEDER 1 | ROLLER UNIT D | 15 | 60 | 40 | 25 |
| SHEET FEEDER 2 | ROLLER UNIT B | 45 | 60 | 30 | 25 |
| SHEET FEEDER 3 | ROLLER UNIT C | 30 | 60 | 20 | 25 |
| SHEET FEEDER 4 | ROLLER UNIT A | 60 | 90 | 10 | 25 |

*FIG.10-2*

| | | WEAR RATIO | THRESHOLD VALUE | USAGE RATE | THRESHOLD VALUE |
|---|---|---|---|---|---|
| SHEET FEEDER 1 | ROLLER UNIT D | 15 | 60 | 15 | 25 |
| SHEET FEEDER 2 | ROLLER UNIT B | 45 | 60 | 15 | 25 |
| SHEET FEEDER 3 | ROLLER UNIT C | 30 | 60 | 60 | 25 |
| SHEET FEEDER 4 | ROLLER UNIT A | 60 | 90 | 10 | 25 |

| | | WEAR RATIO | THRESHOLD VALUE | USAGE RATE | THRESHOLD VALUE |
|---|---|---|---|---|---|
| SHEET FEEDER 1 | ROLLER UNIT D | 36 | 60 | 50 | 25 |
| SHEET FEEDER 2 | ROLLER UNIT C | 39 | 60 | 30 | 25 |
| SHEET FEEDER 3 | ROLLER UNIT B | 60 | 90 | 10 | 25 |
| SHEET FEEDER 4 | ROLLER UNIT A | 65 | 90 | 10 | 25 |

*FIG.11-5*

APPARATUS AND METHOD OF CONTROLLING INTERCHANGE BETWEEN COMPONENT PARTS IN THE APPARATUS

BACKGROUND OF THE INVENTION

1. Field of the Invention

The present invention relates to an apparatus having a plurality of component parts interchangeably disposed in a plurality of component positions, respectively, and a method of controlling interchange between component parts in the apparatus.

2. Description of the Related Art

Conventionally, an image forming apparatus needs replacement of a component part in use when the service life of the component part expires. In such a case, when the image forming apparatus notifies the user of the need to replace the component part, the user informs a service person of the fact, and the service person replaces the component part. Alternatively, the service person detects a component part with only a short remaining service life by referring to counter information during regular maintenance, and replaces the component part without being notified by the image forming apparatus of the need to replace the component part. Particularly, feed rollers, conveying rollers, and retard rollers are more likely to wear than the other component parts, and hence they tend to inevitably need replacement more frequently.

Recently, in place of a business form in which a service person is indispensable for parts replacement, installation, or regular maintenance, a serviceless business form employed in compact segment devices has been coming into use for apparatuses with a large print volume. With this tendency, it is expected that regular consumable parts will be made into kits or units so as to facilitate replacement work by users, whereby replacement of the regular consumable parts, which has been conventionally performed by a service person, will be more and more often performed by each user himself/herself.

If the parts replacement by the user is realized, it can be envisaged that even when an image forming apparatus notifies the user that there is a component part whose service life has expired and recommends the user to replace the component part, the user will not replace the component part with a new one insofar as he/she can normally use the image forming apparatus.

As a consequence, the continuous use of the component part whose service life has expired can cause new abnormality (e.g. frequent occurrence of print jams) that cannot be recovered only by the parts replacement, and eventually work by the service person can be additionally necessitated.

Further, component parts are different in use frequency and hence are also different in the length of remaining service life. Therefore, if a notification is issued whenever a component part whose service life has expired is detected, work load applied to the user will probably be increased.

To eliminate the above-mentioned inconveniences, when an image forming apparatus is provided with a plurality of sheet feeding mechanisms which have the same function and enable the user to select any of them in perform an image forming operation in a desired out form, there has been proposed a technique of preferentially using a sheet feeder which is least frequently used (see Japanese Patent Laid-Open Publication No. 2001-005351). According to this technique, the wear degrees of component parts of the mechanism are made uniform. More specifically, when a component part having a short remaining service lifer is detected, the subsequent usage rate of the component part is caused to be reduced.

Further, Japanese Patent Laid-Open Publication No. H11-327381 discloses a printing system which uses a technique for storing a history and the like of regular replacement parts and component parts replaced due to failure, in an image forming apparatus thereof. This printing system is comprised of a means for identifying the individual identities of respective replacement component parts, a means for counting the remaining service life of each component part and storing the count, a means for counting an accumulated replacement count, and a means for storing the history of the count indicative of the remaining service life after replacement and the accumulated replacement count of each component part.

However, the above-described conventional image forming apparatus suffers from the following problems: When the technique disclosed in Japanese Patent Laid-Open Publication No. 2001-005351 is employed, e.g. in a case where A4-size sheets are designated for all the four sheet feeders of an image forming apparatus having a 4-stage sheet feeding mechanism, it is possible to automatically select a sheet feeder to be preferentially used. However, when sheet sizes designated for the respective sheet feeders are different from each other, it is expected that there cannot be found any sheet feeders which can be automatically selected.

Further, in a case where the technique disclosed in Japanese Patent Laid-Open Publication No. 2001-005351 is employed for a user who intends to reduce a first print time by feeding A4 sheets from the uppermost sheet feeder, automatic selection can make the first print time longer than before the automatic selection e.g. when the lowermost sheet feeder is automatically selected to feed A4-size sheets therefrom.

When the technique disclosed in Japanese Patent Laid-Open Publication No. H11-327381 is employed, it is possible to store a count indicative of a remaining service life and a replacement history in association with an identification means uniquely assigned to each component part. However, when a component part in use is not replaced with a new article, but interchanged with another component part in use e.g. based on operational conditions, the identification means cannot be taken over, which makes it impossible to keep matching with respective histories of the parts before the interchange.

SUMMARY OF THE INVENTION

The present invention provides an apparatus which is capable of substantially prolonging the service live of each component part, in terms of a time period over which a user can use without replacement thereof, and preventing the degradation of apparatus specifications before and after parts interchange work by the user, and a method of controlling interchange between component parts in the apparatus.

In a first aspect of the present invention, there is provided an apparatus having a plurality of component parts interchangeably disposed in a plurality of component positions, respectively, comprising a judgment unit configured to judge whether or not to carry out interchange between a component position of a first component part and a component position of a second component part, based on wear ratios of the respective component parts and usage rates associated with the respective component positions, and a notification unit configured to be operable when it is judged by the judgment unit that the interchange between the component position of the first component part and the component position of the second component part is to be carried out, to perform notification for prompting a user to carry out the interchange.

In a second aspect of the present invention, there is provided an apparatus having a plurality of component parts interchangeably disposed in a plurality of component positions, respectively, and unique identifiers assigned to the respective component parts, comprising a determining unit configured to determine that interchange of component parts has been carried out when a correspondence between the identifiers of the respective component parts and the component positions is changed, an information interchange unit configured to be operable when it is determined by the determining unit that the interchange between the component parts has been carried out, and at the same time, the identifiers of the component parts subjected to the interchange are detected from among the identifiers of the respective component parts, to determine that interchange of component positions is carried out between the component parts, and interchange pieces of information on the identifiers according to the interchanged component positions, and an initialization unit configured to be operable when it is determined by the determining unit that the interchange of the component parts has been carried out and at the same time, no identifiers of the component parts subjected to the interchange are detected from among the identifiers of the respective component parts, to determine that at least one of the component parts has been replaced with a new component part other than the component parts, and initialize information associated with an identifier of the new component part.

In a third aspect of the present invention, there is provided a method of controlling parts interchange in an apparatus having a plurality of component parts interchangeably disposed in a plurality of component positions, respectively, comprising determining whether or not to carry out interchange between a component position of a first component part and a component position of a second component part, based on wear ratios of the respective component parts and usage rates associated with the respective component positions, and performing notification for prompting a user to carry out the interchange, when it is determined that the interchange between the component position of the first component part and the component position of the second component part is to be carried out.

In a fourth aspect of the present invention, there is provided a method of controlling parts interchange in an apparatus having a plurality of component parts interchangeably disposed in a plurality of component positions, respectively, and unique identifiers assigned to the respective component parts, comprising determining that interchange of component parts has been carried out when a correspondence between the identifiers of the respective component parts and the component positions is changed, determining, when it is determined that the interchange between the component parts has been carried out, and at the same time, the identifiers of the component parts subjected to the interchange are detected from among the identifiers of the respective component parts, that interchange of component positions is carried out between the component parts, and interchanging pieces of information on the identifiers according to the interchanged component positions, and determining, when it is determined that the interchange of the component parts has been carried out and at the same time, no identifiers of the component parts subjected to the interchange are detected from among the identifiers of the respective component parts, that at least one of the component parts has been replaced with a new component part other than the component parts, and initializing information associated with an identifier of the new component part.

In a fifth aspect of the present invention, there is provided an apparatus having a plurality of component parts disposed in respective positions, comprising a judgment unit configured to judge, based on a wear condition of a first component part of the plurality of component parts and a usage condition of a position where the first component part is mounted, whether or not to move the first component part from the position thereof, and a notification unit configured to be operable when it is judged by the judgment unit that the first component part is to be moved from the position thereof, to perform notification for prompting a user to move the first component part to a position where a second component part of the plurality of component parts is mounted.

In a sixth aspect of the present invention, there is provided a method of controlling parts interchange in an apparatus having a plurality of component parts disposed in respective positions, comprising judging, based on a wear condition of a first component part of the plurality of component parts and a usage condition of a position where the first component part is mounted, whether or not to move the first component part from the position thereof, and performing notification for prompting a user to move the first component part to a position where a second component part of the plurality of component parts is mounted, when it is judged that the first component part is to be moved from the position thereof.

According to the present invention, it is possible to substantially prolong the service lives of the respective component parts in the apparatus, in terms of a time period over which a user can use without replacement thereof, and to prevent apparatus specifications from being reduced before and after parts interchange work by the user.

The features and advantages of the invention will become more apparent from the following detailed description taken in conjunction with the accompanying drawings.

BRIEF DESCRIPTION OF THE DRAWINGS

FIGS. 8-1 to 8-11 are diagrams useful in explaining parts interchange determination 1.

FIGS. 10-1 to 10-6 are diagrams useful in explaining parts interchange determination 2.

FIGS. 11-1 to 11-5 are diagrams useful in explaining parts interchange determination 3.

DETAILED DESCRIPTION OF THE EMBODIMENTS

The present invention will now be described in detail below with reference to the accompanying drawings showing an embodiment thereof.

Hereafter, a description will be given of an apparatus and a method of controlling parts interchange in the image forming apparatus, according to the embodiment of the present invention. The apparatus according to the embodiment is applied to an MFP (Multi-Function Printer).

Figure 1:
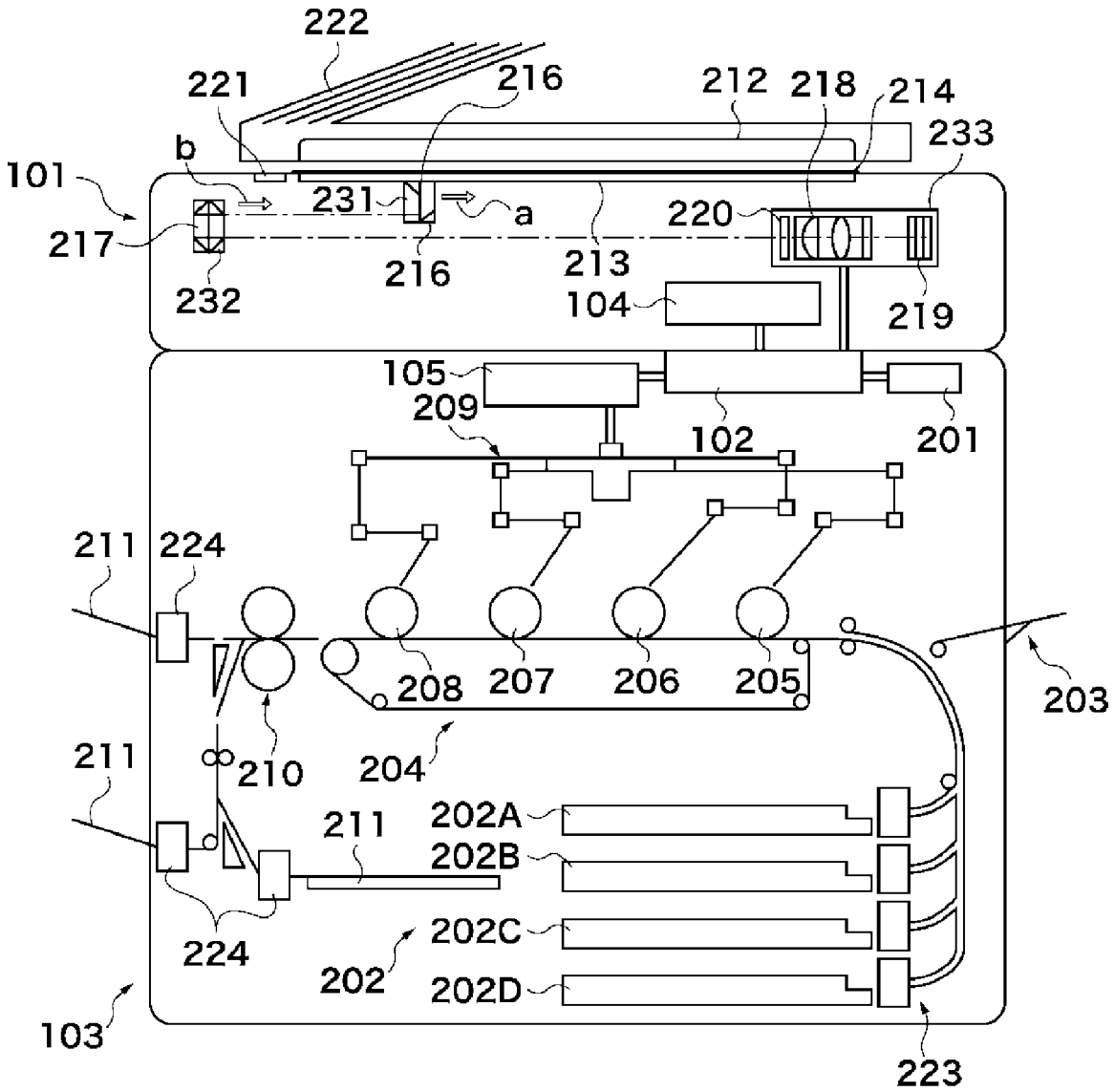
FIG. 1 is a schematic longitudinal cross-sectional view of an image forming apparatus as an apparatus according to an embodiment of the present invention.

FIG. 1 is a schematic longitudinal cross-sectional view of an image forming apparatus as the apparatus according to the present embodiment. Although in the present embodiment, the following description will be given by taking the MFP as example as mentioned above, the present invention is also applicable to an SFP (Single Function Printer) because the SFP has the same arrangement as the MFP except for an image scanner section 101.

The image forming apparatus is comprised of the image scanner section 101 and a printer engine section 103. During a copy operation, in the image scanner section 101, originals 214 fed from an automatic document feeder 222 are sequentially placed between an original platen glass 213 and an original presser plate 212 and are irradiated with light from a halogen lamp 215.

Reflected light from an original 214 is guided by mirrors 216 and 217 to pass through a lens 218 to form an image on a 3-line sensor 219. It should be noted that the lens 218 is provided with an infrared cut filter 220.

A mirror unit 231 including the halogen lamp 215 and the mirror 216 is mechanically driven by a motor (not shown) to move at a velocity V in a direction indicated by an arrow AA in FIG. 1, i.e. a direction (sub scanning direction) orthogonal to a mechanical scanning direction (main scanning direction) of the 3-line sensor 219. The entire surface of the original 214 is scanned by this motion of the mirror unit 231. Similarly, a mirror unit 232 including the mirror 217 moves at a velocity V/2 in a direction indicated by an arrow AB in FIG. 1.

A reader controller 104 controls a CCD unit 233 including the lens 218, the 3-line sensor 219, and a CCD driver (not shown), and the mirror units 231 and 232.

The 3-line sensor 219 comprised of three lines of CCDs performs color separation of received optical information, reads RGB color components forming full-color information, carries out shading correction, and thereafter sends color component signals associated with the respective color components to a controller 102. The controller 102 performs various kinds of image processing. A reference white plate 221 is used to correct data read by the CCDs of the 3-line sensor 219. The reference white plate 221 has a white color having substantially uniform reflection characteristics in the visible light region.

The controller 102 is connected to an operation section 201, the reader controller 104, and a printer controller 105. On the operation section (operation panel) 201, there are arranged switches for various operations, an LED display device, an LCD module, and so forth.

The controller 102 performs system control and controls the image scanner section 101 and the printer engine section 103 according to instructions from the operation section 201 so as to cause them to carry out image forming operation. Further, the controller 102 performs communication with an external interface (not shown). In an actual image forming operation, the controller 102 electrically processes image signals input from the 3-line sensor 219 to thereby generate Y (yellow), M (magenta), C (cyan), and K (black) color component signals, and outputs these to the printer controller 105.

The printer controller 105 delivers the Y, M, C, and K color component signals as independent video signals to a laser scanner unit 209 of the printer engine section 103.

The printer engine section 103 starts a sheet feeding operation for feeding recording sheets into the apparatus from one of sheet feed cassettes 202 or a manual feed tray 203 in timing synchronous with the start of a printing operation. Each of the recording sheet fed into the apparatus is conveyed by a conveying unit 204 such that the recording sheet passes through developing units 205, 206, 207, and 208 sequentially.

At the same time, the laser scanner unit 209 drives a semiconductor laser device in a modulating manner according to the input video signals to thereby switch on and off the emission of laser beams. The output laser beams in the respective colors scan photosensitive drums of respective developing units 205, 206, 207, and 208 via polygon mirrors, f-θ lenses, etc. within the laser scanner unit 209 to form electrostatic latent images on photosensitive drums associated with the respective colors Y, M, C, and K.

Each of the electrostatic latent images formed on the respective photosensitive drums is developed using an associated color toner, whereby a toner image is formed. This operation is carried out in timing synchronous with conveyance of a recording sheet, whereby the toner images are transferred onto the recording sheet conveyed by the conveying unit 204.

Thus, the Y, M, C, and K toner images are sequentially transferred onto the recording sheet and then thermally fixed by a fixing unit 210, whereby a desired color image is formed on the recording sheet. Thereafter, the recording sheet having the color image formed thereon is discharged onto a discharge tray 211. Sheet feed roller units 223 are regular consumable parts for parts interchange in the present invention, and the sheet feed roller units 223 are each used for feeding a recording sheet from an associated sheet feed cassette into the apparatus. Similarly, sheet discharge roller units 224 are regular consumable parts for parts interchange in the present invention, and the sheet discharge roller units 224 are each used for conveying a recording sheet having passed through the fixing unit 210 to an associated one of discharge trays 211.

On the other hand, during a printing operation, the controller 102 stores print information (character code and the like), form pattern information, and a macro command supplied from an external apparatus (not shown) via an external interface, such as a centronics, a USB, or an Ethernet (registered trademark), in a RAM of the controller 102 itself.

Further, the controller 102 causes a rendering controller to generate raster data composed of a character pattern, a form pattern, and so forth, based on the associated input information, causes an image processing section to generate bitmap data associated with each of the colors Y, M, C, and K, and then causes the raster data and the bitmap data to be output to the printer controller 105. Operations performed by the printer engine section 103 from this time on are similar to those for copying, and hence description thereof is omitted.

As described above, the image forming apparatus is capable of performing development on a color-by-color basis, which makes it possible to obtain a color output image at a very high speed in both copying and printing.

Figure 2:
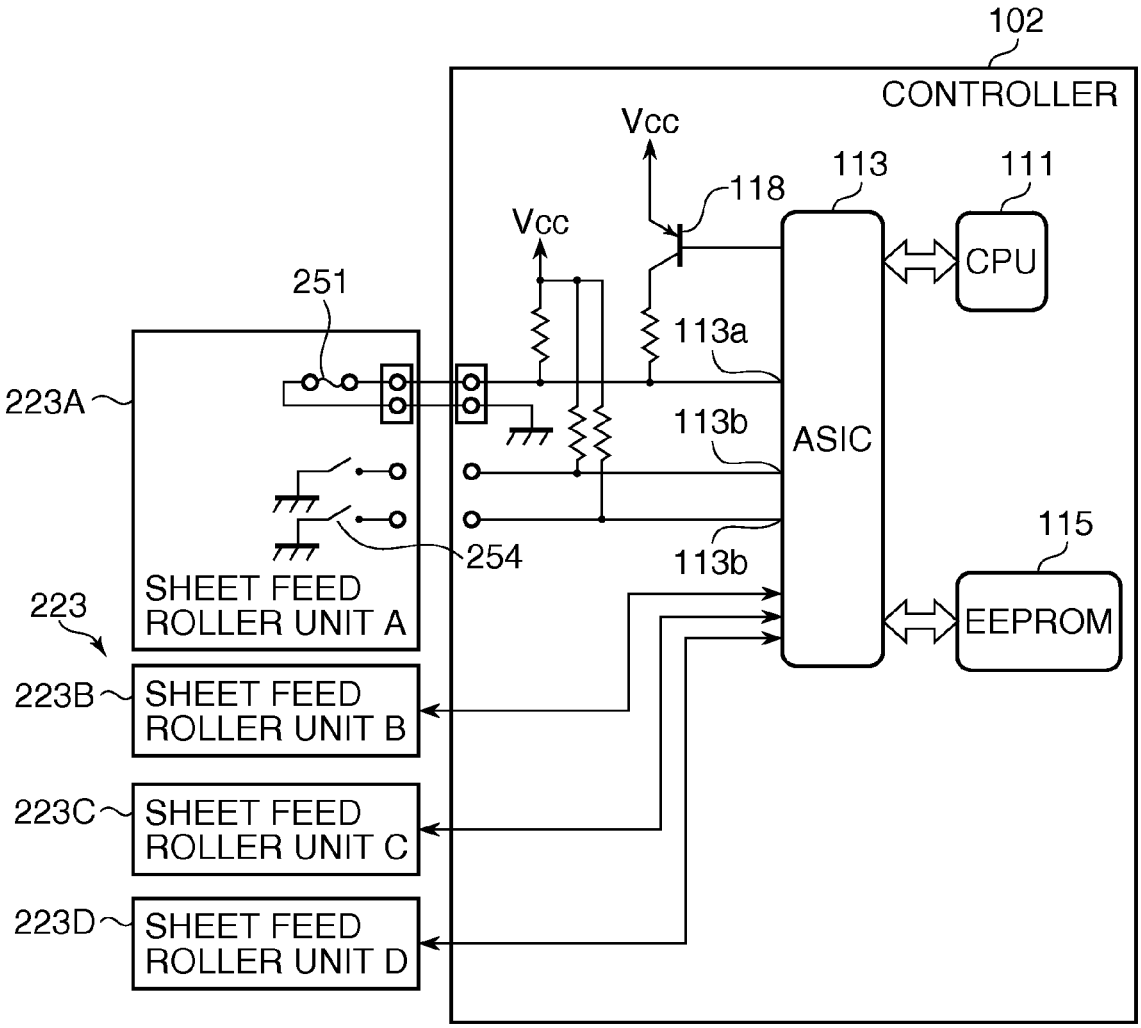
FIG. 2 is a diagram of part of a controller for causing respective identifiers of component parts in use to be taken over before and after parts interchange.

Next, a description will be given of an operation for interchange between component parts used in the image forming apparatus constructed as above. First, how an identifier of a component part in use is determined and how the history of counter information is taken over will be described. FIG. 2 is a diagram of part of the controller 102 for causing respective identifiers of component parts in use to be taken over before and after parts interchange.

The controller 102 is connected to the image scanner section 101 and the printer engine section 103. The controller 102 controls the reader controller 104 and the printer controller 105 according to an instruction from the operation panel 201 to perform image forming operation. The controller 102 also performs communication with the external interface.

The sheet feed roller units 223 (223A to 223D) are regular consumable parts for feeding recording sheets into the apparatus from the respective sheet feed cassettes 202 (202A to 202D). In the present embodiment, the sheet feed roller units 223A to 223D are generically referred to as the sheet feed roller units 223 when it is not particularly required to differentiate between the sheet feed roller units 223A to 223D. Similarly, the sheet feed cassettes 202A to 202D are generically referred to as the sheet feed cassettes 202 when it is not particularly required to differentiate between the sheet feed cassettes 202A to 202D.

The controller 102 includes a CPU 111 that controls the overall operation of the present image forming apparatus in a centralized manner, an ASIC (Application Specific Integrated Circuit) 113 that provides overall control of access to external apparatuses and deices and is provided with functions for compressing and expanding image data, and an EEPROM (Electrically Erasable and Programmable ROM) 115. The EEPROM 115 stores information on specifications of the present image forming apparatus, such as read speed, print speed, and a language to be used. Further, the EEPROM 115 stores counter information from each sheet feed roller unit and page information from each sheet feed cassette. More specifically, the EEPROM 115 stores a table showing information (counter information and threshold values of respective wear ratios) associated with identifiers of the respective sheet feed roller units, and information (page information and threshold values of respective usage rates) on the sheet feed cassettes (see FIGS. 8-1 to 8-11).

In processing for determining the identifiers unique to the respective sheet feed roller units 223, first at a time point when the power of a new image forming apparatus is turned on for the first time after purchase of the apparatus, it is detected whether or not the sheet feed roller units 223 are new articles.

As a specific method of detecting a new article, there has been proposed a monitoring system disclosed in Japanese Patent Laid-Open Publication No. H06-76140. More specifically, when a new-article detection determining pin 113*a* of the ASIC 113 detects an "L" level just after purchase of the new image forming apparatus, the ASIC 113 causes an electric current to flow through a new-article detecting fuse (FU) 251 provided within the associated sheet feed roller 223 by turning on a PNP transistor 118 provided outside the ASIC 113, to thereby disconnect the FU 251. From then on, whenever the power is turned on, an "H" level is detected by the new-article detection determining pin 113*a* of the ASIC 113. This makes it possible to determine whether each of the sheet feed roller units 223 currently in use is a new article or used one.

Subsequently, a determination switch 254 provided for each of the sheet feed roller units 223 is set such that it matches an associated sheet feeder. In the present embodiment, each determination switch 254 is formed by 2 bits. Of course, ON/OFF of each determination switch 254 may be preset before shipping of the image forming apparatus.

Specifically, in the sheet feed roller unit 223A to be used for a sheet feeder 1, the determination switch 254 is set to "OFF, OFF". Similarly, in the sheet feed roller unit 223B to be used for a sheet feeder 2, the determination switch 254 is set to "OFF, ON". Similarly, in the sheet feed roller unit 223C to be used for a sheet feeder 3, the determination switch 254 is set to "ON, OFF", and in the sheet feed roller unit 223D to be used for a sheet feeder 4, the determination switch 254 is set to "ON, ON".

Then, after information on the settings of each of the determination switches is reflected in the image forming apparatus, the controller 102 determines the value (unique identifier) of each determination switch 254 by an associated unique-identifier determining pin 113*b* of the ASIC 113 to thereby prepare for a case where a user happens to perform an erroneous configuration for an operation of the image forming apparatus.

Figure 3:
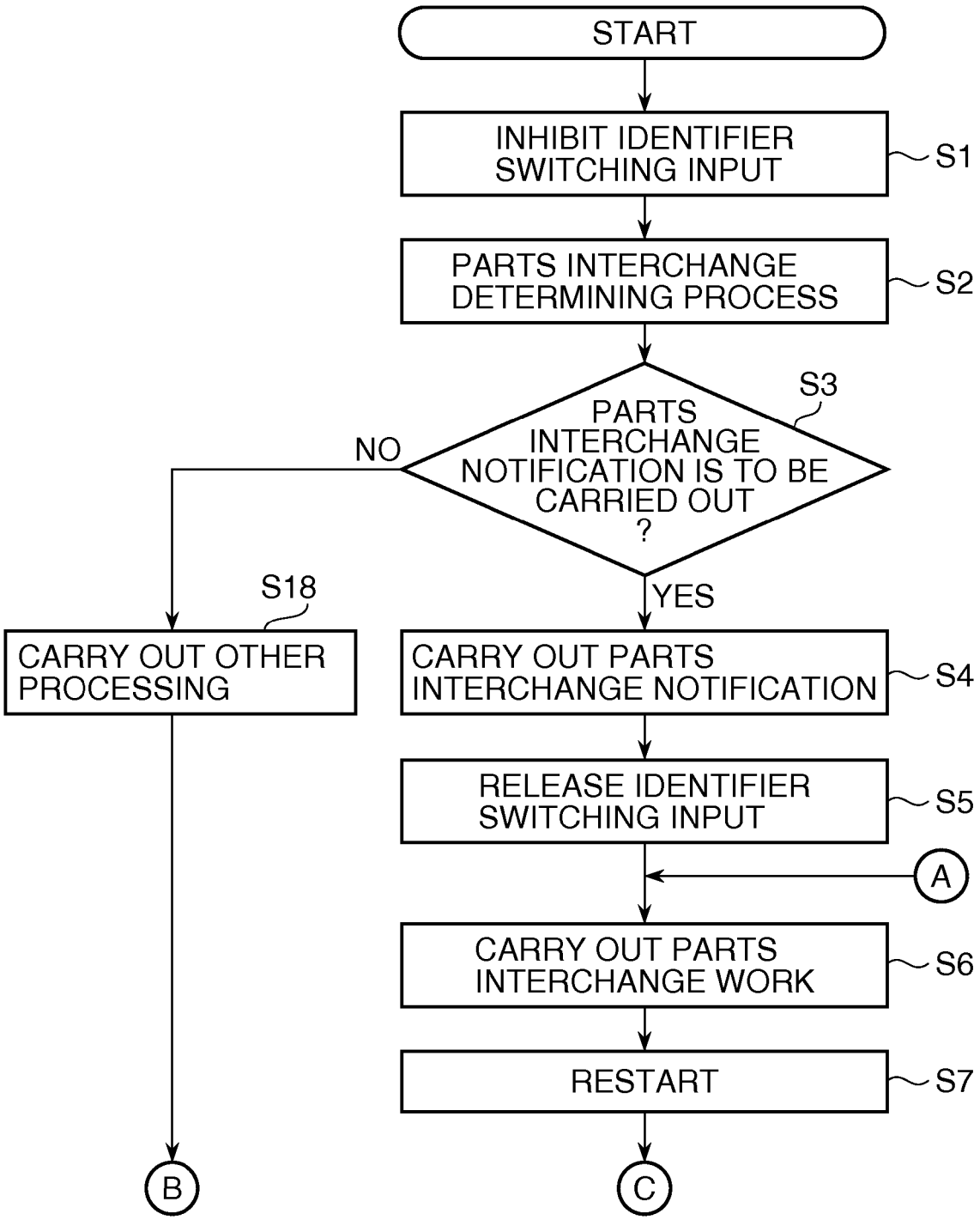
FIG. 3 is a flowchart of a parts interchange process.
Figure 4:
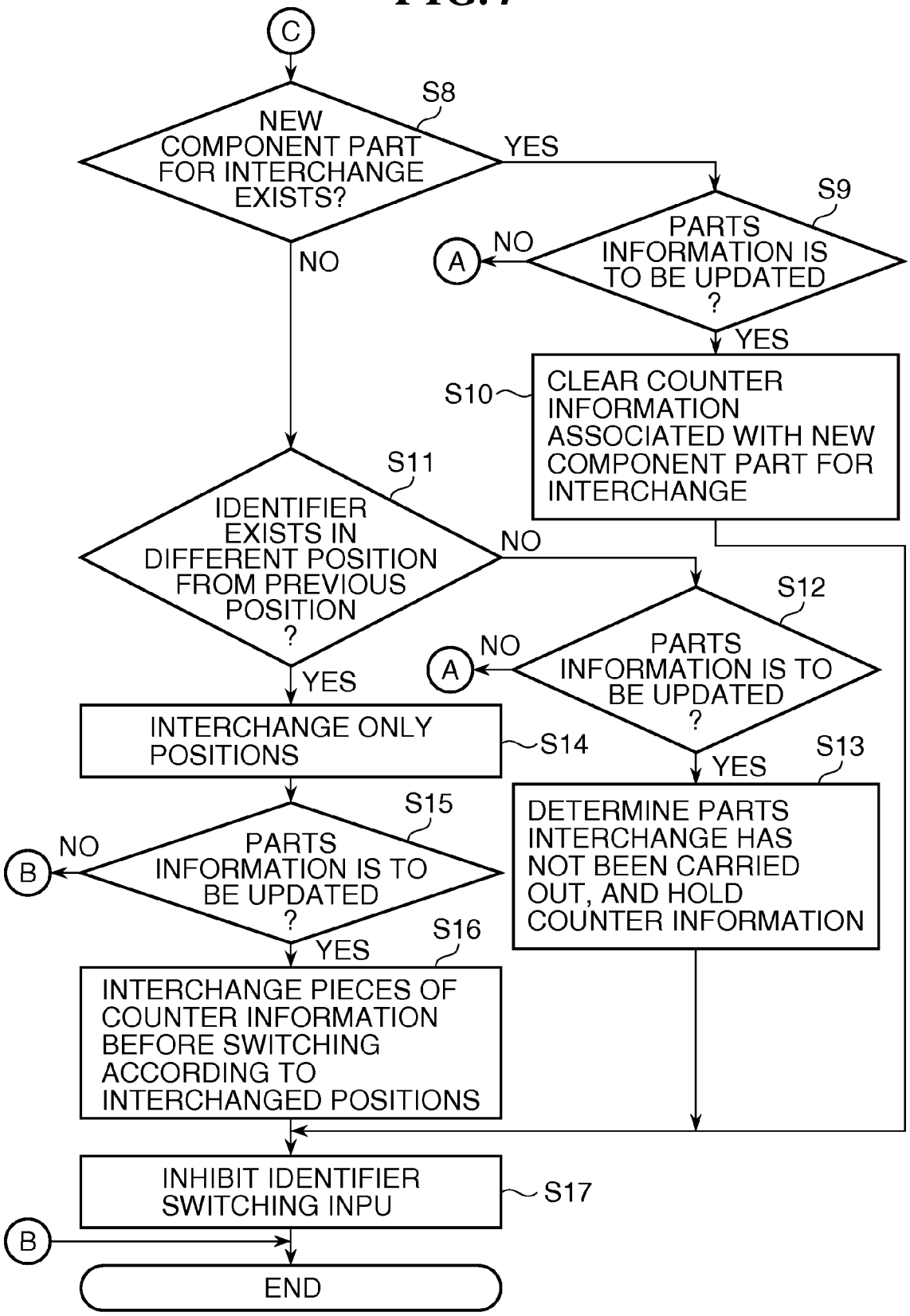
FIG. 4 is a continuation of FIG. 3.

When it is thus confirmed that the appropriate new articles have been initially connected to respective correct positions, the controller 102 starts a parts interchange process shown in FIGS. 3 and 4. A control program for this parts interchange process is stored in a ROM within the CPU 111 and executed by the CPU 111 at the start of the apparatus. It should be noted that the present process can be executed not only at the start of the apparatus, but also in any timing e.g. designated by the user.

First, when the initial settings are correct, the controller 102 inhibits identifier switching input to be executed for switching between identifiers, such that an error call is generated when any one of the identifiers is connected to a different position from the position to which it was connected at the time of the preceding start of the image forming apparatus, until the present image forming apparatus issues a parts interchange notification (step S1). This step is executed so as to prevent unnecessary interchange between the sheet feed roller units 223. This finally determines correspondence between the identifiers and the respective associated part positions.

Figure 5:
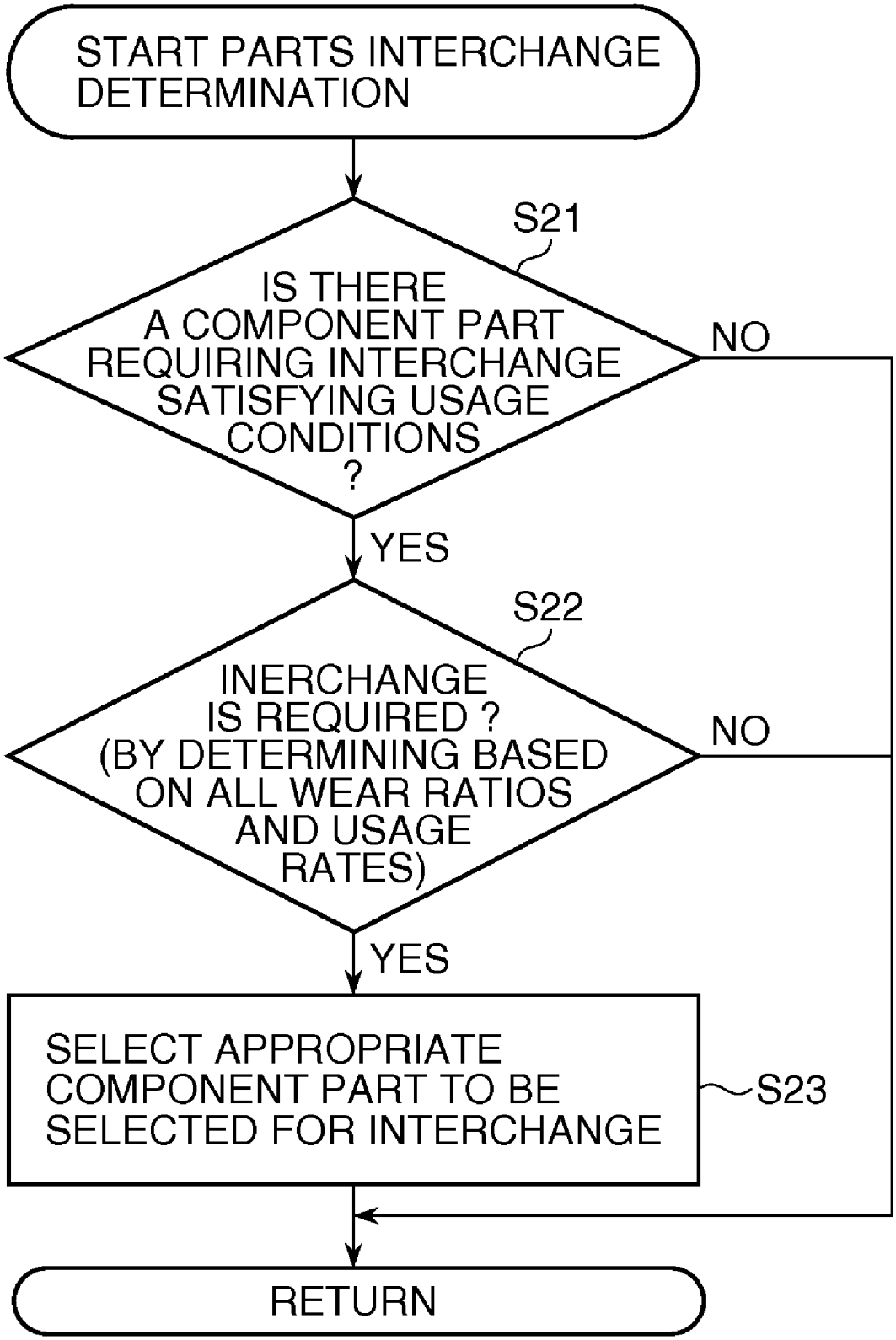
FIG. 5 is a flowchart of a parts interchange determining process.

The controller 102 determines whether or not parts interchange is required (step S2). FIG. 5 is a flowchart of the parts interchange determining process executed in the step S2. In this parts interchange determining process, the controller 102 determines whether or not there is any component part requiring interchange, which satisfies conditions 1 and 2 as usage conditions for the present image forming apparatus (step S21). In the present embodiment, the condition 1 is such that the wear ratio of at least one of all the sheet feed roller units 223 has exceeded a threshold value (first threshold value: 60% in the present example) thereof predefined in the image forming apparatus. The wear ratio can be obtained as a value determined by dividing the current value of a component part operation counter for counting sheet-feeding operations i.e. sheets fed by the respective operations in association with the corresponding feed roller unit by an upper limit value of the service life (upper limit value of the count of sheet-feeding operations which can be performed using the associated feed roller unit) of the sheet feed roller unit (e.g. 2000 sheets/8000 sheets=25%). If the condition 1 is satisfied, determination as to the condition 2 is performed. The condition 2 is such that the usage rate of a sheet feeder associated with the sheet feed roller unit 223 has exceeded a threshold value of the usage rate (second threshold value) expected assuming that the sheet feed roller units are used equally, i.e. the wear rates of the respective sheet feed roller units are uniform. In the present example, the threshold value of the usage rate is set to 25%, i.e. a value of ¼ which is determined as a ratio of the number of output pages from one sheet feeder to the number of total output pages since the present image forming apparatus has four sheet feeders in a four-stage stack. The usage rate can be obtained as a value determined by dividing the current value of an output page counter associated with the sheet feeder by the total count of output pages from the apparatus (e.g. 1000 sheets/2000 sheets=50%). When the condition 2 is satisfied, i.e. when the two conditions (parts interchange conditions) for both the wear ratio and the usage rate are satisfied, the sheet feed roller unit is regarded as a target for parts interchange notification (i.e. a component part requiring interchange). The output page counter provided for each sheet feeder stage may be implemented by software or by using hardware, e.g. a sensor for detecting a sheet-feeding operation of the associated sheet feeder. Each output page counter continuously performs counting irrespective of interchange between sheet feed roller units. Therefore, the count represents the number of sheet-feeding operations performed at the associated sheet feeder. In contrast, the component part operation counter provided in association with each sheet feed roller unit, which may be implemented by software or by using hardware, counts the number of operations of the associated sheet feed roller unit. Therefore, when sheet feed roller units are interchanged, the counts of the respective component operation counters, stored e.g. in respective positions in a table in association with respective corresponding sheet feeders, are also interchanged according to the interchange of the respective positions of the sheet feed roller units between the sheet feeders.

If it is determined in the step S21 that there is no component part requiring interchange which satisfies the parts interchange conditions, the controller 102 immediately terminates the present process and returns to the main process. On the other hand, if it is determined in the step S21 that there is a component part requiring interchange which satisfies the parts interchange conditions, the controller 102 determines, based on the wear ratios of the respective sheet feed roller units 223A to 223D and the usage rates of the respective sheet feeders, whether or not it is required to interchange the sheet feed roller unit which satisfies the parts interchange conditions with another (step S22). Even if the parts interchange conditions are satisfied, a criterion of the determination as to whether it is actually required to interchange the sheet feed roller unit with another can be set as desired. This will be described hereinafter based on an example.

If it is not required to interchange any of the sheet feed roller units 223, the controller 102 immediately terminates the present process and returns to the main process. On the other hand, if it is determined in the step S22 that it is required to interchange the component part requiring interchange by another, an appropriate component part to be selected for interchange is selected (step S23). Basically in this step for selecting an appropriate component part to be selected for interchange, a sheet feed roller unit whose wear ratio is the smallest is selected as a component part to be selected for interchange. A criterion of this determination can be set as desired, and this will also be described hereinafter based on an example. After execution of the step S23, the controller 102 terminates the present process and returns to the main process.

After having performed the determination as to parts interchange in the step S2, the controller 102 determines whether or not to carry out parts interchange notification (step S3). This judgment is performed by determining whether or not both a component part requiring interchange and a component part to be selected for interchange exist, and when both of them exist, it is determined that parts interchange notification should be carried out. In executing the parts interchange notification, the controller 102 displays information on work to be carried out at the time of parts interchange notification on the operation panel 201 (step S4).

Figure 6:
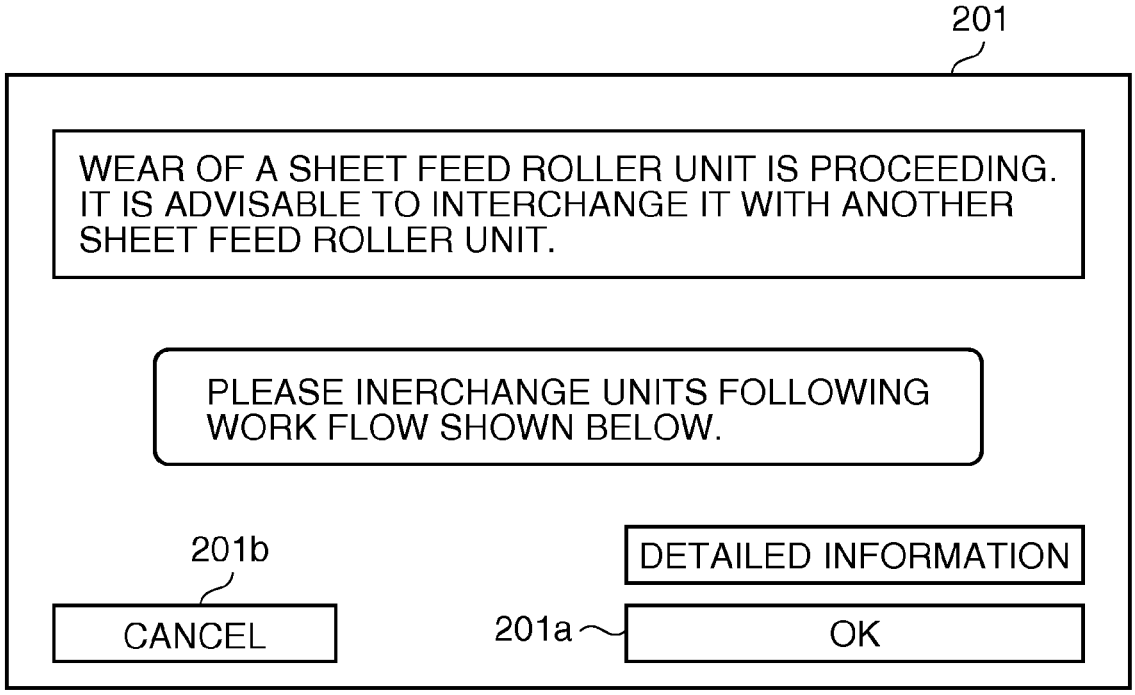
FIG. 6 is a view of a screen displayed on an operation panel so as to inform a user of work to be carried out at the time of a parts interchange notification.

FIG. 6 is a view of a screen displayed on the operation panel 201 so as to inform the user of work to be carried out at the time of parts interchange notification. On the operation panel 201, a message recommending interchange between sheet feed roller units is displayed, and an OK button 201*a* and a cancel button 201*b* are also displayed for selection by the user. Further, it is possible to display details of a flow of the work for interchange between the sheet feed roller units. The details of the flow of the work for interchange are displayed in a manner enabling the user to understand which sheet feed roller to be interchanged with which sheet feed roller. This may be performed by displaying respective names of the sheet feed rollers for interchange, or by displaying such a cross-sectional view as shown in FIG. 1 and highlight locations of the component parts for the actual interchange. At this time, one of the two which is worn and the other to be interchanged therewith may be displayed in a distinguishable manner. Further, there may be displayed not the screen displaying the details of the flow but a message saying "Wear of a sheet feed roller unit is proceeding. It is advisable to interchange it with another sheet feed roller unit." shown in FIG. 6, with "a sheet feed roller unit" and "another sheet feed roller unit" in the message being substituted for by the respective names of sheet feed rollers for an actual interchange. For example, there may be displayed a message saying "Wear of Sheet feed roller unit A is proceeding. It is advisable to interchange it with Sheet feed roller unit B."

Upon notification of the message shown in FIG. 6, the controller 102 cancels the inhibition of the identifier switching input to get ready for a subsequent parts interchange work (step S5). The controller 102 is held on standby for restart of the apparatus after the OK button 201*a* is selected until the parts interchange work by the user is completed (step S6). When the parts interchange work by the user is completed, the image forming apparatus is restarted (step S7). The completion of the parts interchange work can be confirmed by the values of the unique-identifier determining pins 113*b* of the ASIC 113 or by detecting user's selection of a restart button which is displayed on the operation panel 201 together with a message recommending the restart of the apparatus. It should be noted that when the cancel button 201*b* is selected with the operation panel 201 held in the state shown in FIG. 6, the controller 102 forcibly terminates the present process.

After the restart of the apparatus, the controller 102 proceeds to an operation for checking the unique identifiers. First, the controller 102 determines whether or not there is a new component part for interchange (step S8). More specifically, the controller 102 determines whether or not there is a component part (sheet feed roller unit) which is detected to be at the "L" level by the new-article detection determining pin 113*a* of the ASIC 113.

Figure 7:
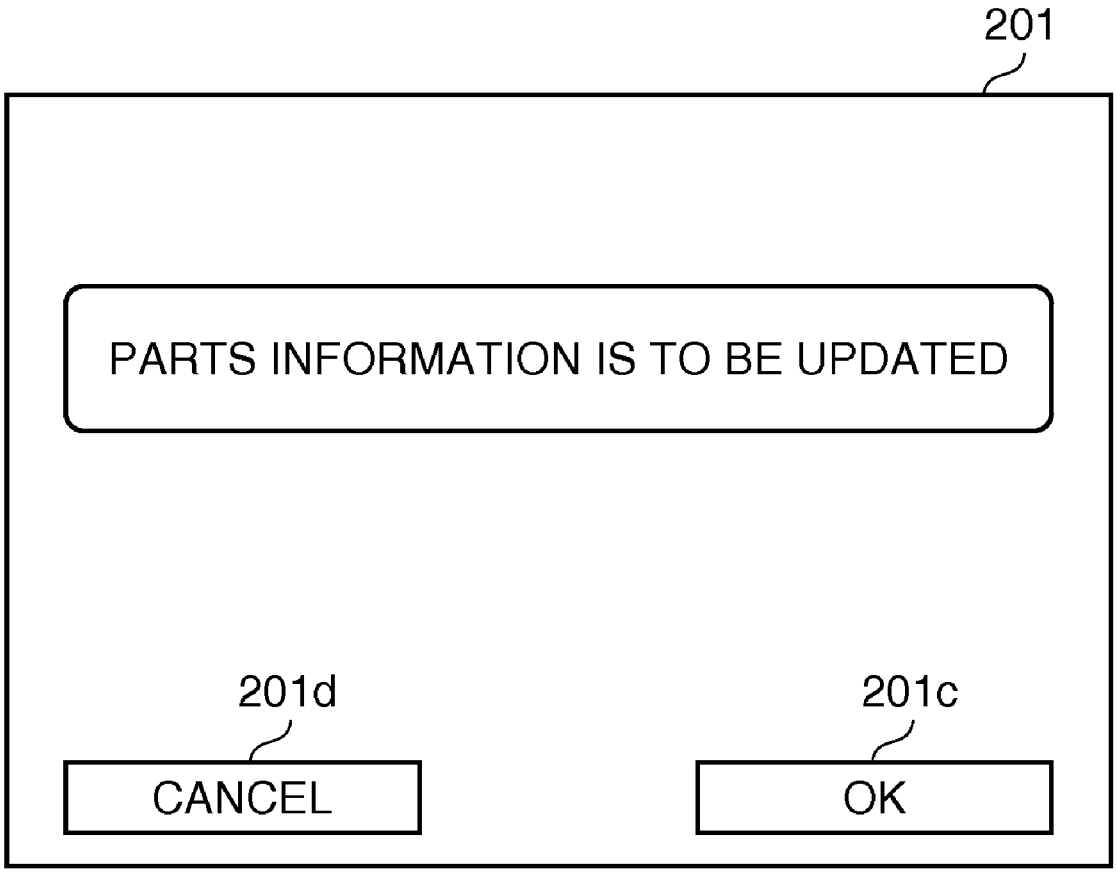
FIG. 7 is a view of a confirmation screen displayed on the operation panel for requesting a user to confirm execution of the update of parts information.

If there is any component part detected to be at the "L" level by this check, the controller 102 determines that a component part has been replaced with the new one. The new component part here is an example of a component part other than a plurality of component parts defined in claims 4, 5, and 7. Then, when the component part is an appropriate one and is mounted in a correct position, the controller 102 displays a confirmation screen for requesting the user to confirm execution of the update of parts information (see FIG. 7) and determines whether or not to update the parts information (step S9). FIG. 7 is a view of the confirmation screen displayed on the operation panel 201 for requesting the user to confirmation execution of the update of the parts information. This screen displays not only a message indicating that the parts information is going to be updated, but also an OK button 201*c* and a cancel button 201*d* for selection by the user.

If the user selects the cancel button 201*d* to cancel updating the parts information, the process returns to the step S6, wherein the controller 102 displays the message presented on the screen shown in FIG. 6 to thereby again prompt the user to carry out parts interchange work.

On the other hand, if the user selects the OK button 201*c* to approve updating the parts information, the controller 102 initializes (clears) the counter information (count of the component part operation counter) and wear ratio threshold information associated with the sheet feed roller unit as the new component part for interchange (step S10), and then the process proceeds to a step S17. Of course, the process may be configured such that when an appropriate new article has been mounted in a correct position, the counter information and the wear ratio threshold information are automatically cleared without displaying the FIG. 7 confirmation screen for requesting the user to confirm execution of the update of the parts information.

On the other hand, if all the currently used component parts are detected to be at the "H" level in the step S8, i.e. if there is no new component part for interchange, the controller 102 determines whether or not parts interchange has been performed (step S1). More specifically, the controller 102 determines respective positions of the determination switches 254 of the sheet feed roller units 223 connected to the sheet feeders, using the unique-identifier determining pins 113*b* of the ASIC 113, respectively.

If none of the unique-identifier determining pins 113*b* have changed their respective positions from the positions detected at the preceding start of the apparatus and hence the determination switches 254 are detected to be in the same positions as at the preceding start of the apparatus, the controller 102 determines that parts interchange work has not been carried out by the user despite the issue of the parts interchange notification. Then, after notifying the user that parts interchange work has not been carried out by the user, the controller 102 displays the FIG. 7 screen so as to prompt the user to update the parts information, and then determines whether or not to update the parts information (step S12).

If the user cancels updating the parts information by selecting the cancel button 201*d* so as to carry out parts interchange work again, the process returns to the step S6, wherein the controller 102 displays the message presented on the screen shown in FIG. 6 to thereby again prompt the user to carry out the parts interchange work.

On the other hand, if the user selects the OK button 201*c* to thereby approve updating the parts information, the controller 102 determines that parts interchange work load applied to the user is large and hence the work has been left undone on purpose. Then, the controller 102 only updates the threshold value of the wear ratio for next parts interchange determination/notification, and holds the counter information and the wear ratio threshold information in the EEPROM 115 without updating these (step S13), and then the process proceeds to the step S17.

On the other hand, if there are determination switches 254 detected to be in different positions from respective positions at the preceding start of the apparatus based on information from the associated unique-identifier determining pins 113*b* in the step S11, the controller 102 determines that only positional interchange between component parts used in the apparatus has occurred (step S14).

If the component parts are in respective correct mounted positions as a result of the user work, the controller 102 requests the user to confirm the update of the parts information by displaying the confirmation screen shown in FIG. 7, and then determines whether or not to update the parts information (step S15).

If the user selects the cancel button 201*d* to thereby cancel updating the parts information, the process returns to the step S6, wherein the controller 102 displays the message presented on the screen shown in FIG. 6 to thereby again prompt the user to carry out the parts interchange work.

On the other hand, if the user selects the OK button 201*c* to thereby approve updating the parts information, the controller 102 causes stored pieces of the counter information and the wear ratio threshold information before the part interchange to be interchanged according to with respective interchanged positions of the sheet feed roller units 223 (step S16). The process may be configured such that when the component parts are in the correct mounted positions, the pieces of the counter information and the wear ratio threshold information are automatically interchanged without displaying the confirmation screen, similarly to the case of checking whether or not there is a new component part for interchange. Further, in the step S16, the threshold value of the wear ratio of the component part interchanged as a target for interchange is updated to a larger value.

Then, upon completion of the updating of the counter information and the wear ratio threshold information, performed in response to the parts interchange notification, the controller 102 inhibits identifier switching input (step S17). This processing is executed so as to prevent unnecessary interchange between sheet feed roller units 223 until next issue of parts interchange notification. In case a unique identifier is connected to a position different from a position detected at the preceding start of the apparatus, the controller 102 generates an error call. After the step S17, the present process is terminated.

On the other hand, if it is determined in the step S3 that parts interchange notification is not to be performed, the controller 102 carries out other processing (step S18), followed by terminating the present process. The other processing includes processing for carrying out only updating the threshold value of the wear ratio of a component part without executing parts interchange, and processing for giving an instruction for replacing all the component parts with new articles, as will be described hereinafter.

Next, a description will be given of examples of parts interchange determination.

FIGS. 8-1 to 8-11 are diagrams useful in explaining parts interchange determination 1. The example of the parts interchange determination 1 will be described following the order of diagram numbers.

The present image forming apparatus has four sheet feed cassettes 202 in a four-stage stack and four sheet feed roller units 223 associated therewith, as described hereinbefore, and in the present embodiment, in carrying out parts interchange, the user is assumed to be notified by the image forming apparatus of necessity of parts interchange between sheet feed roller units 223, and carry out parts interchange work.

The sheet feed cassettes 202 have values of usage rate set by default as follows: The usage rate of the sheet feed cassette 202A, i.e. the usage rate of A4-size sheets in the sheet feed cassette 202A is equal to 40%, the usage rate of the sheet feed cassette 202B, i.e. the usage rate of A4-size sheets in the sheet feed cassette 202B is equal to 30%, the usage rate of the sheet feed cassette 202C, i.e. the usage rate of B5-size sheets in the sheet feed cassette 202C is equal to 20%, and the usage rate of the sheet feed cassette 202D, i.e. the usage rate of A3-size sheets in the sheet feed cassette 202D is equal to 10%. Further, it is assumed that the sheet feed roller units 223 used for the respective sheet feeders have the same service life, and are identical in mechanism to each other except for the unique identifiers referred to hereinafter.

Figures 3, 8:
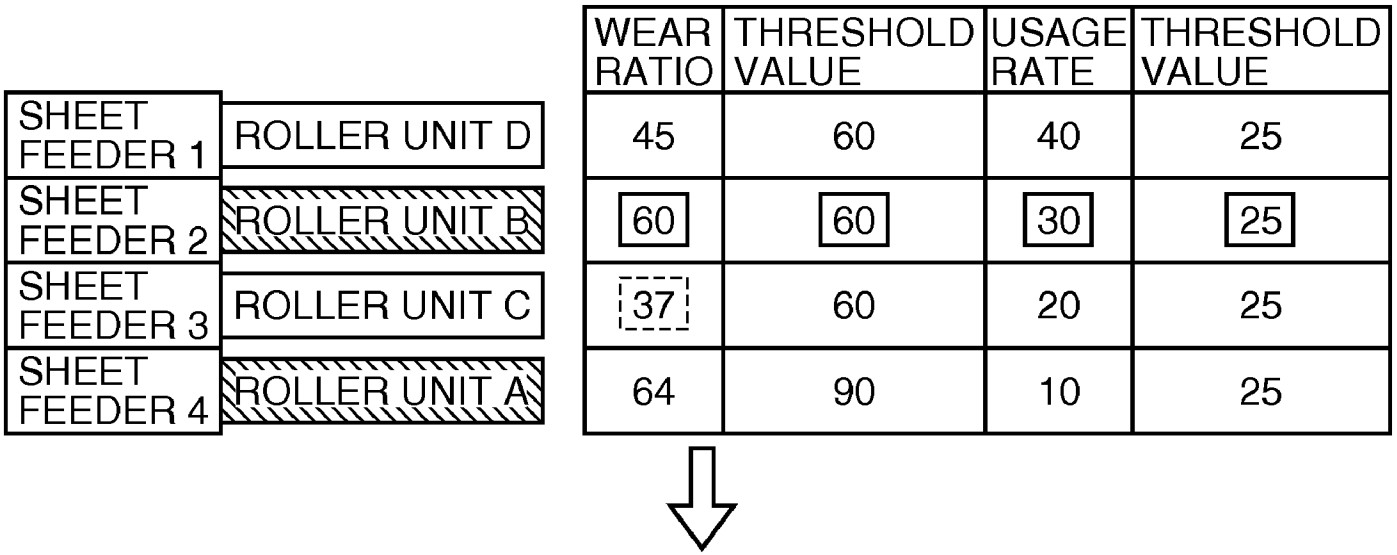
Figures 4, 8:
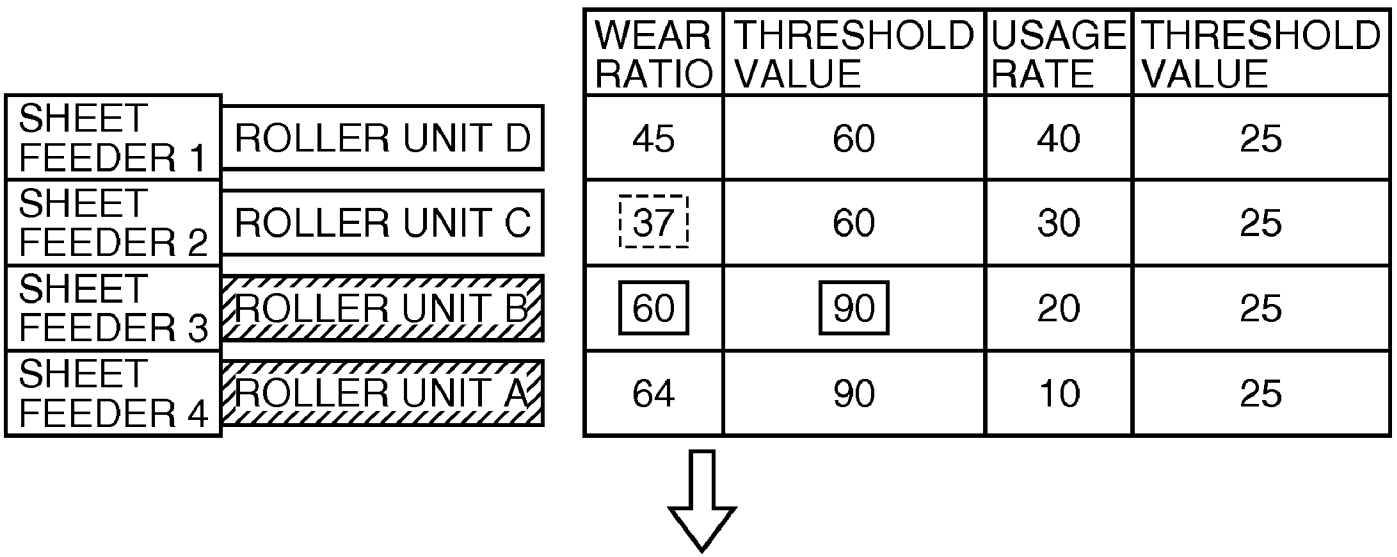
Figures 5, 8:
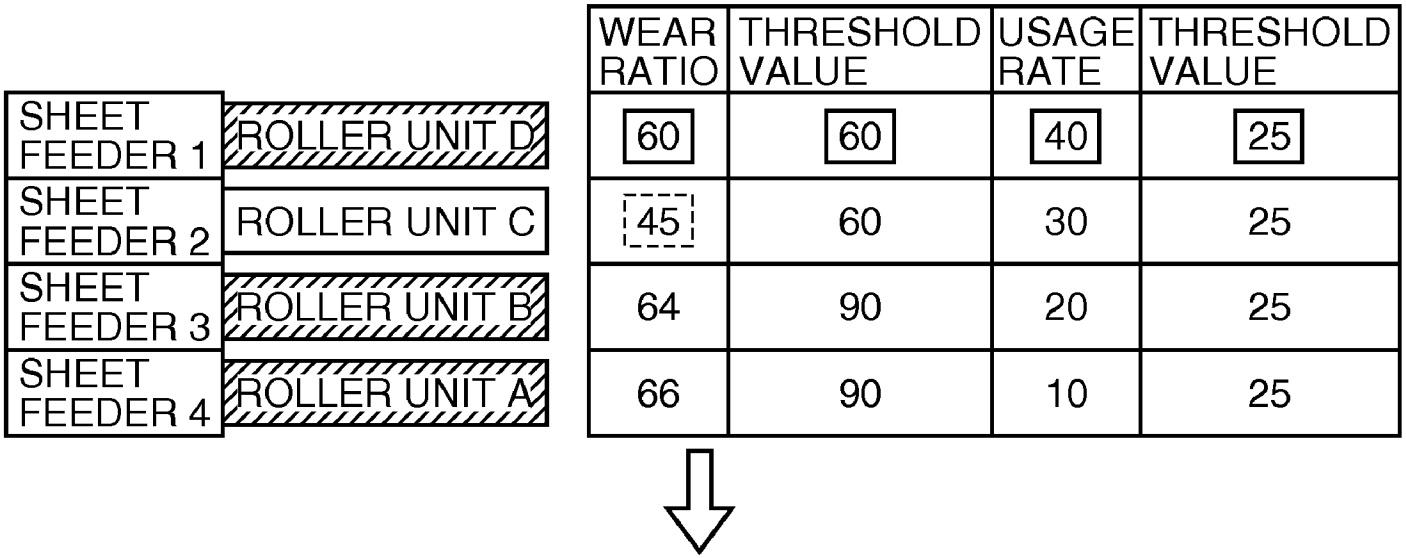
Figures 6, 8:
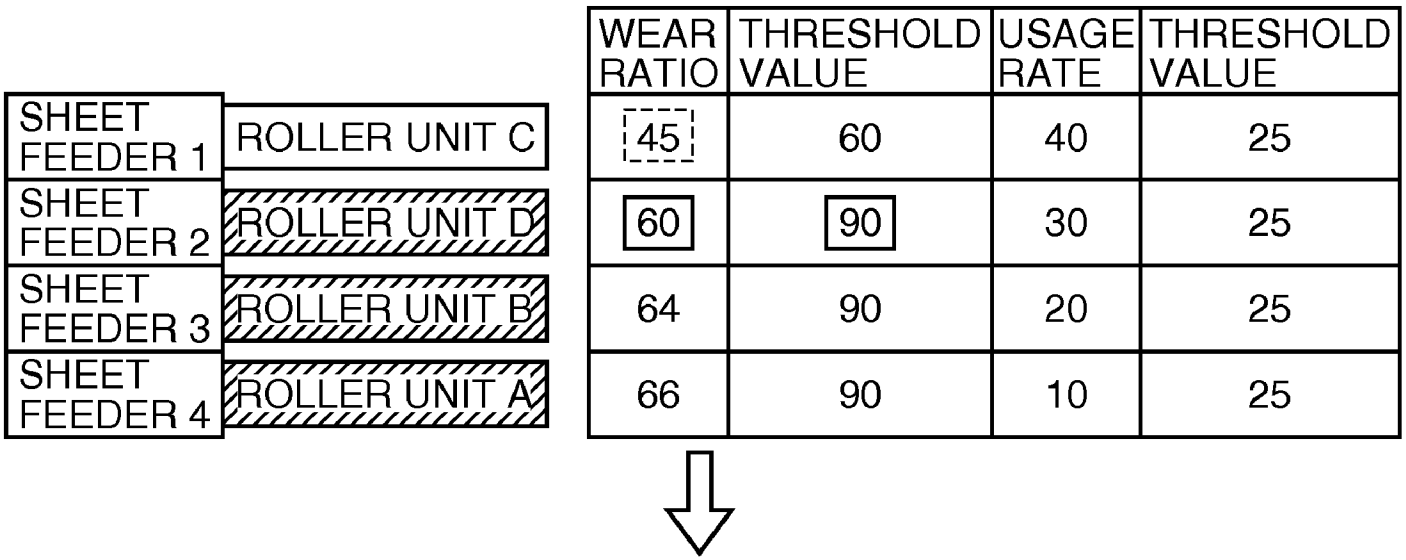
Figures 7, 8:
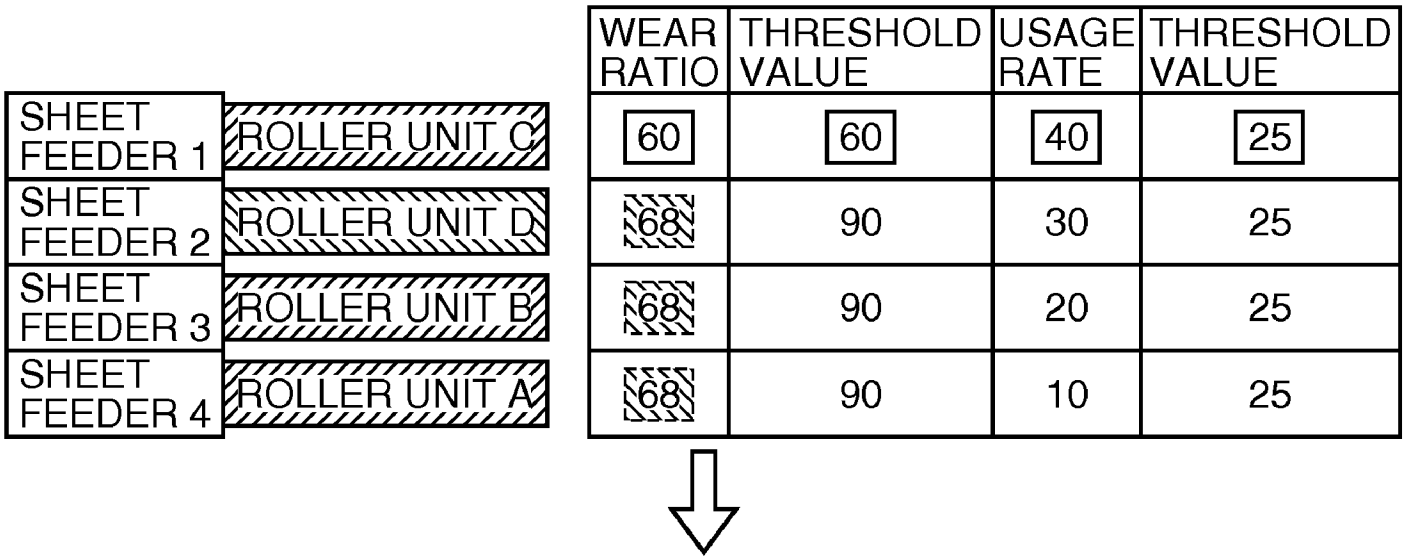
Figure 8:
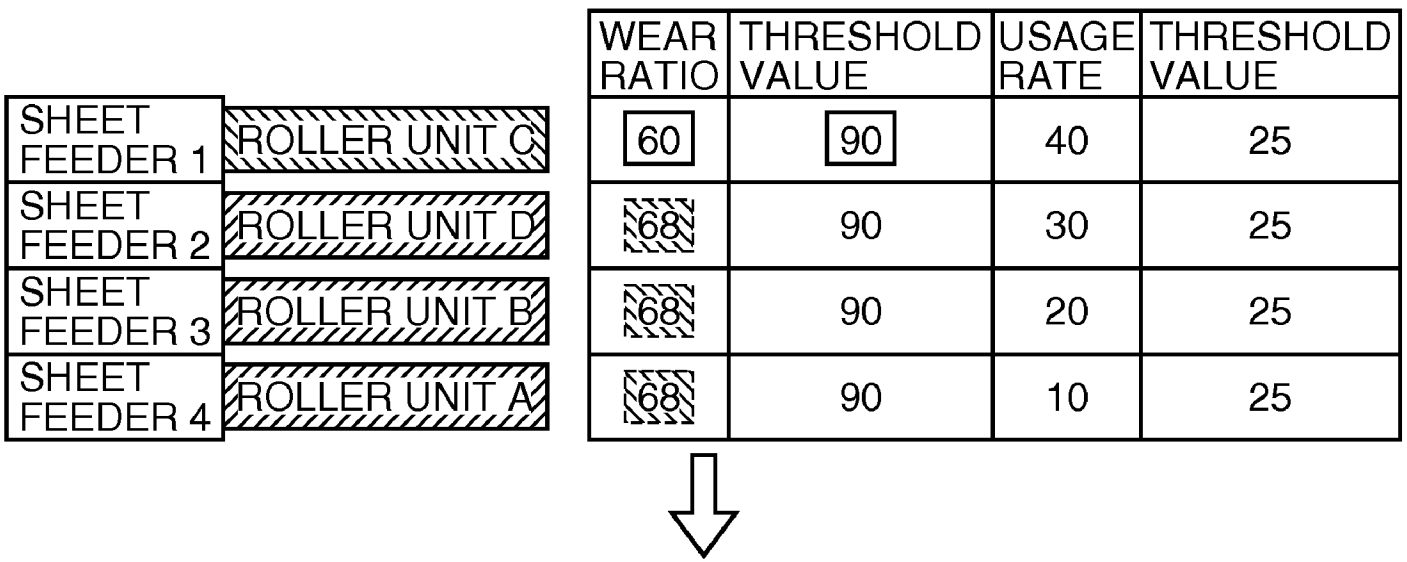

First, FIG. 8-1 shows a case where the condition 1 as a usage condition of the present image forming apparatus is satisfied at a certain time point, i.e. a case where the wear rate of the sheet feed roller unit 223A has reached the wear ratio threshold value (60% in the present example) predefined in the apparatus, at a certain time point. In this case, the usage rate of the sheet feeder associated with the sheet feed roller unit 223A (roller unit A in FIGS. 8-1 to 8-9) is referred to, next.

The usage rate of the sheet feed cassette 202A is 40% as mentioned hereinabove. This numerical value exceeds the usage rate threshold value 25% (equivalent to a value of ¼ which is determined as a ratio of the number of output pages from one sheet feeder to the number of total output pages since the present image forming apparatus has four sheet feeders in a four-stage stack) expected assuming that the sheet feeders are used equally, i.e. that the wear ratios of the respective sheet feed roller units are uniform, which satisfies the condition 2. Therefore, the two conditions about the wear ratio and the usage rate are satisfied, and the sheet feed roller unit 223A is regarded as a target for parts interchange notification (i.e. a component part requiring interchange).

On the other hand, the sheet feed roller unit 223D having the lowest wear ratio in a state shown in FIG. 8-1 is regarded as a component part to be selected for interchange with the sheet feed roller unit A. It should be noted that in actuality, both the wear ratio and the usage rate are referred to, as described hereinafter. Since both the component part requiring interchange and the component part to be selected for interchange are found, the aforementioned message shown in FIG. 6 is displayed on the operation panel 201.

When the user agrees to this message, the operation panel 201 displays positions of the sheet feed roller units 223A and 223D for parts interchange, and instructions concerning how to remove and how to mount a sheet feed roller unit. The user carries out parts interchange work, following the displayed image and instructions.

After completion of the parts interchange work by the user, a restart button is displayed on the operation panel 201 together with a message prompting the user to restart the apparatus, and the image forming apparatus enters a standby state to await restart of the apparatus by the user. When the restart button is selected by the user, the image forming apparatus starts restarting and checks the unique identifiers after the restart.

Since it is detected at the present restart of the image forming apparatus that the sheet feed roller units 223A and 223D are located in different positions from those detected at the immediately preceding restart, it is determined that the sheet feed roller units 223A and 223D have been interchanged only in position therebetween, and the message shown in FIG. 7 is displayed.

When the user agrees to the message, pieces of the counter information on the sheet feed roller unit 223A and that on the sheet feed roller unit 223D stored before the positional interchange are caused to be interchanged according to respective interchanged positions of the sheet feed roller units. The counter information here is not page count information to be used as a base for the usage rate, but information to be used as a base for the wear ratio. The pieces of the counter information are stored in association with the respective sheet feed cassettes. As described hereinbefore, the EEPROM 115 stores a table showing information (wear ratios (based on respective pieces of counter information) and threshold values thereof) associated with the respective identifiers of the sheet feed roller units and information (usage rates (based on respective pieces of page count information) and threshold values thereof) on the respective sheet feed cassettes, in association with the positions of the sheet feeders, respectively (see FIG. 8-1). The correspondence between the positions of component parts (sheet feed roller units) and the identifiers thereof can be checked based on this table.

The image forming apparatus writes the counter information and wear ratio threshold information on the sheet feed roller unit 223A before the interchange into a location where the counter information and wear ratio threshold information on the sheet feed roller unit 223D before the interchange were stored. Further, the image forming apparatus writes the counter information and wear ratio threshold information on the sheet feed roller unit 223D before the interchange into a location where the counter information and wear ratio threshold information on the sheet feed roller unit 223A before the interchange were stored. Then, the image forming apparatus updates the wear ratio threshold value (first threshold value) for the sheet feed roller unit 223A to be increased for next parts interchange and notification. In the present embodiment, the wear ratio threshold value is changed to 90%. FIG. 8-2 shows a thus updated state of the image forming apparatus (more specifically, the states and settings of the sheet feed roller units and associated component parts).

Then, when the image forming apparatus continues to be used with the present usage rates, the state thereof becomes e.g. as shown in FIG. 8-3. More specifically, the wear ratio of the sheet feed roller unit 223B for the sheet feed cassette 202B exceeds its threshold value (60% in the present example), and the usage rate of the sheet feed cassette 202B is 30% i.e. higher than its threshold value of 25%, which means that the two conditions about the wear ratio and the usage rate are satisfied, so that the sheet feed roller unit 223B is regarded as a target for parts interchange notification. On the other hand, the sheet feed roller unit 223C having the lowest wear ratio in the state shown in FIG. 8-3 is regarded as a component part to be selected for interchange with the sheet feed roller unit 223B.

FIG. 8-4 shows a state of the image forming apparatus in which similarly to that shown in FIG. 8-2, the user has carried out work for interchange between the sheet feed roller units 223B and 223C and then has restarted the image forming apparatus. By this restart, the counter information and wear ratio threshold information on the sheet feed roller unit 223B and those on the sheet feed roller unit 223C are interchanged, and a new wear ratio threshold value (90% in the present example) is set for the sheet feed roller unit 223B.

Similarly, between states shown in FIGS. 8-5 and 8-6, parts interchange is performed between the sheet feed roller unit 223D for the sheet feed cassette 202A and the sheet feed roller unit 223C for the sheet feed cassette 202B. When the image forming apparatus continues to be used in this state, the state thereof becomes e.g. as shown in FIG. 8-7.

In the state shown in FIG. 8-7, the wear ratio of the sheet feed roller unit 223C for the sheet feed cassette 202A exceeds its threshold value (60% in the present example), and the usage rate of the sheet feed cassette 202A is higher than its threshold value of 25%. Therefore, the sheet feed roller unit 223C is regarded as a target for parts interchange. However, the wear ratio of each of the sheet feed roller units 223A, 223B, and 223D is higher than the current wear ratio of 60% of the sheet feed roller unit 223C. For this reason, even if parts interchange were carried out, a component part for interchange (the sheet feed roller unit 223A, 223B, or 223D in the present example) would wear out earlier than the sheet feed roller unit 223C will when the image forming apparatus continues to be used without execution of the parts interchange. Therefore, FIG. 8-8 shows a state of the image forming apparatus which does not issue the parts interchange notification with a view to optimizing timing for parts interchange and reducing work load on the user, but performs only the update of the wear ratio threshold value for the sheet feed roller unit 223C for next parts interchange determination/notification.

If the image forming apparatus continues to be used from then on while applying the wear ratio of 90% to processing similar to that executed theretofore, parts interchange notification is performed three times. Through a total of six user operations for parts interchange, including the three parts interchange operations executed before, the state of the image forming apparatus becomes e.g. as shown in FIG. 8-9.

At this time point, all the sheet feed roller units have wear ratios equal to or higher than the threshold value of 90% with reference to which each sheet feed roller unit is judged to have "small service life margin" in the present embodiment. Therefore, when the wear ratio of any one of the sheet feed roller units exceeds the threshold value next time, it can be determined that the service life of the component part has almost completely expired. Further, all the other sheet feed roller units from which a component part to be selected for interchange is to be selected have "small service life margin", and hence in a state shown in FIG. 8-10, there is no component part to be selected for interchange.

In a state of the image forming apparatus shown in FIG. 8-11, a notification prompting the user to replace the sheet feed roller unit whose service life has almost completely expired with a new article is output with a view to optimizing timing for parts interchange and reducing work load on the user. At the same time, a notification prompting the user to replace the other sheet feed roller units each having "small service life margin" with new articles is also output. Of course, it is possible to obtain the same effects by informing a service person instead of issuing the replacement notification to the user.

Figure 9A:
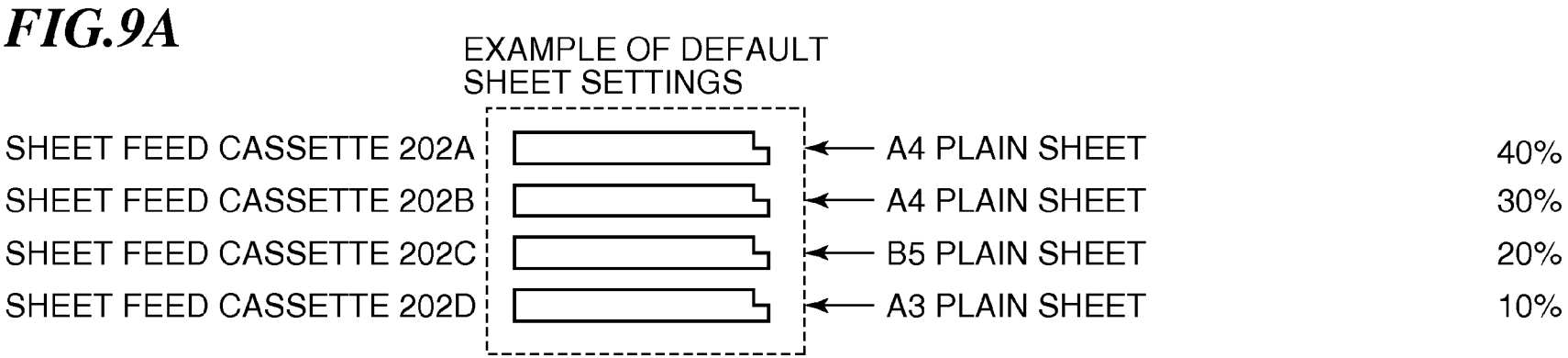
FIGS. 9A and 9B are diagrams useful in explaining changes in usage rate in actual use of the image forming apparatus.
Figure 9B:
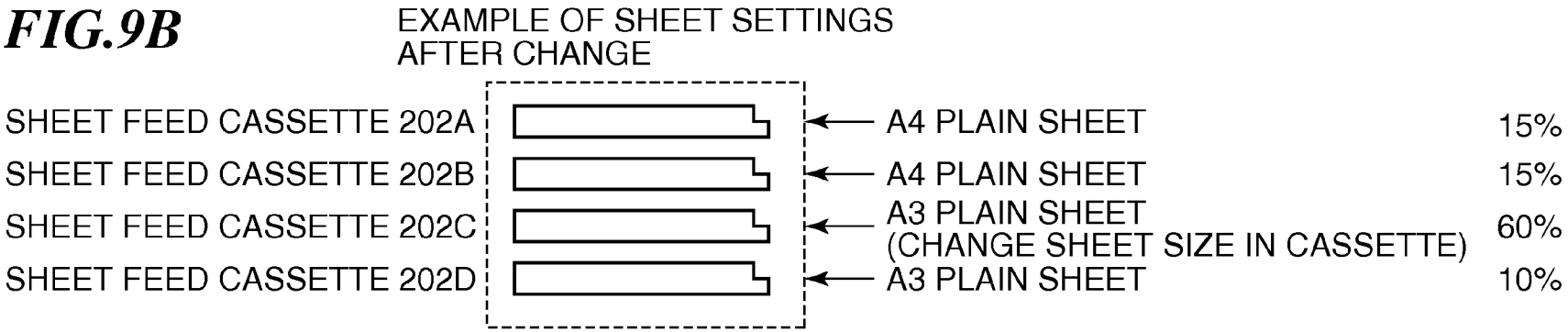

The parts interchange determination 1 shows a case where it is assumed that the usage rates do not vary from default sheet settings. However, in an actual usage environment, there is a possibility that the usage rates will change. FIGS. 9A and 9B are diagrams showing how the usage rates change in the actual use of the image forming apparatus. As described hereinbefore, the sheet feed cassettes 202A to 202D contain A4-size plain sheets, A4-size plain sheets, B5-size plain sheets, and A3-size plain sheets, respectively. In the parts interchange determination 1, an environment is assumed in which where A4-size sheets are output most frequently, and hence in the default sheet settings, the usage rates of the respective sheet feed cassettes 202A to 202D are set to 40%, 30%, 20%, and 10%, respectively.

Parts interchange determination 2 shows a case where the necessity of output of A3-size sheets occurs abruptly and the usage rates of the respective sheet feeders are changed. More specifically, as shown in FIGS. 9A and 9B, the usage rates of the respective sheet feeders, i.e. the respective sheet feed cassettes 202A to 202D are changed to 15%, 15%, 60%, and 10%, respectively, during operation of the image forming apparatus.

Figures 3, 10:
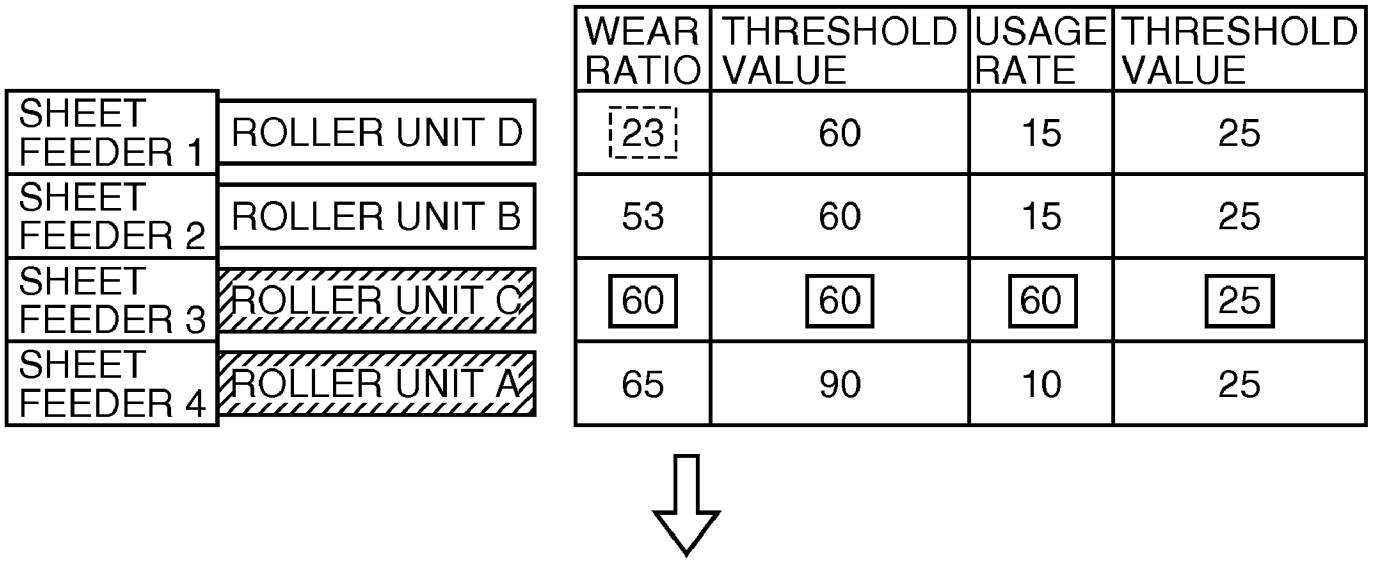
Figures 4, 10:
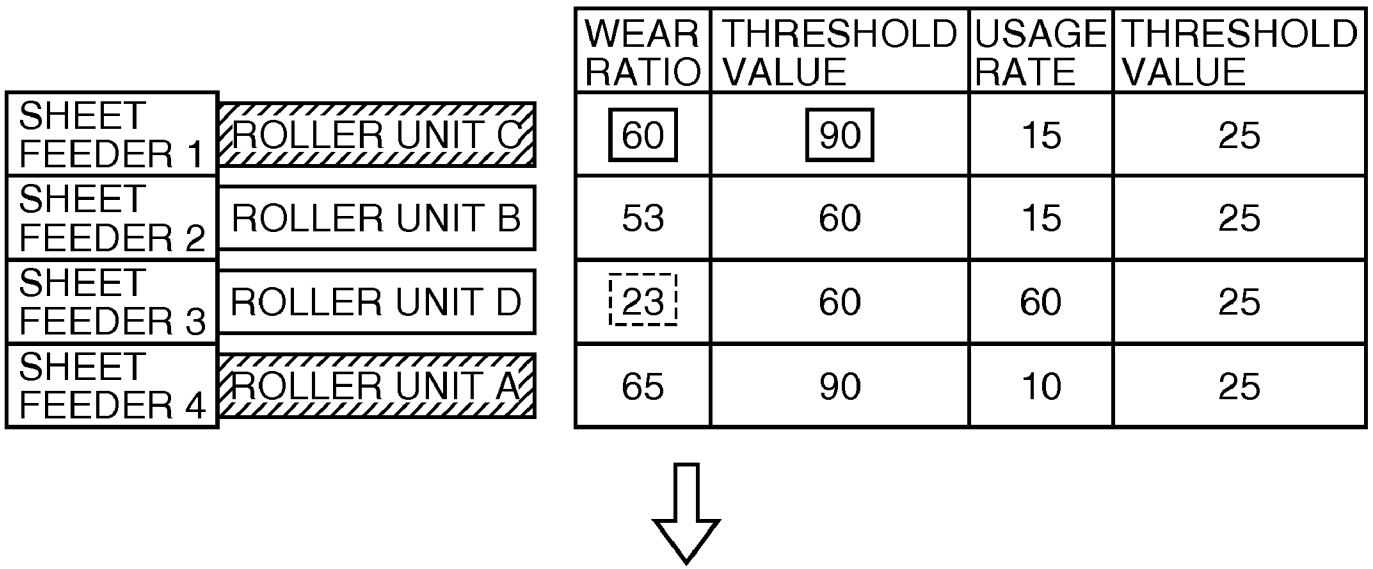
Figures 5, 10:
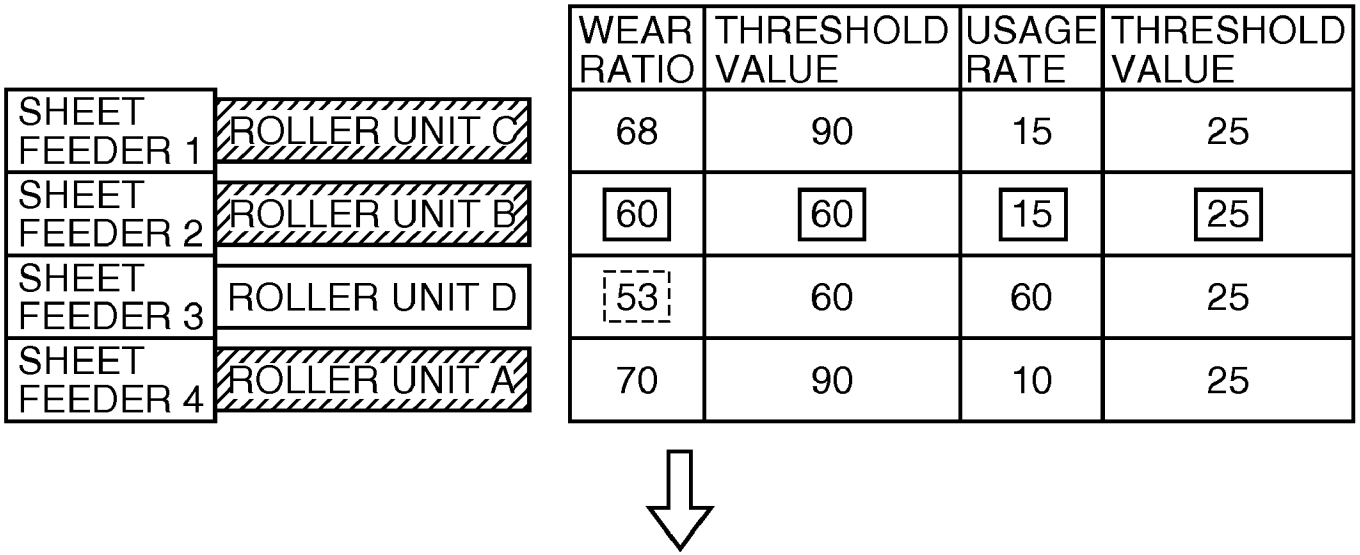
Figures 6, 10:
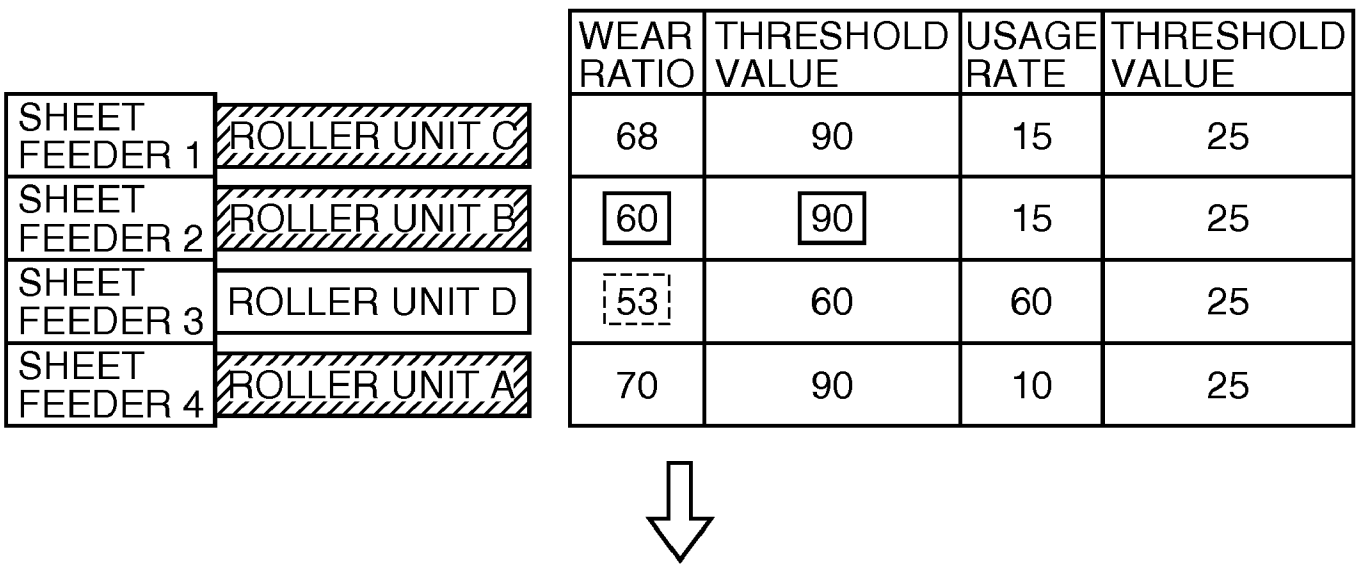

FIGS. 10-1 to 10-6 are diagrams useful in explaining the parts interchange determination 2. The present example shows a case where due to changes in the usage rates, the usage rate of a sheet feeder on an interchange target side (i.e. a sheet feeder currently associated with a component part requiring interchange) is lower than the others. In the parts interchange determination 2, changes are shown from the state shown in FIG. 8-2, assuming that the settings and usage environment before the state are the same as those in the parts interchange determination 1.

First, the necessity of output of A3-size sheets occurs abruptly in a state of the image forming apparatus (more specifically, the states and settings of the sheet feed roller units and associated component parts) shown in FIG. 10-1 corresponding to FIG. 8-2, and the usage rates are changed from those in the past environment where A4-size sheets were output most frequently. In a state shown in FIG. 10-2, the usage rates of the respective sheet feeders, i.e. the respective sheet feed cassettes 202A to 202D are changed to 15%, 15%, 60%, and 10%, respectively.

When the image forming apparatus continues to be used from the state shown in FIG. 10-2, the state thereof becomes e.g. as shown in FIG. 10-3 in which the wear ratio of the sheet feed roller unit 223C and the usage rate of the sheet feeder 3 (i.e. the sheet feed cassette 202C) satisfy conditions for interchange, so that the sheet feed roller unit 223C is regarded as a target for parts interchange notification. The image forming apparatus displays a parts interchange notification on the operation panel 201, so as to prompt the user to interchange the sheet feed roller unit 223C with the sheet feed roller unit 223D having the lowest wear ratio at this time point.

FIG. 10-4 shows a state of the image forming apparatus in which after completing the parts interchange, stored pieces of the counter information and wear ratio threshold information are interchanged between the sheet feed roller units 223C and 223D, and then the threshold value of the wear ratio of the sheet feed roller unit 223C is updated such hat it is increased.

The operations up to FIG. 10-4 are the same as those performed in the parts interchange determination 1. However, the parts interchange determination 2 is characterized by operations thereafter. When the image forming apparatus continues to be used from the state shown in FIG. 10-4, the state thereof becomes e.g. as shown in FIG. 10-5. In this state, the wear ratio of the sheet feed roller unit 223B has reached its threshold value of 60%, but the usage rate of the sheet feed roller unit 223B is 15%, i.e. lower than its threshold value of 25%. In short, the condition of the wear ratio is satisfied, but the condition of the usage rate is not.

Therefore, in this case in the parts interchange determination 2, the parts interchange notification is not issued, and FIG. 10-6 shows a state in which the image forming apparatus performs only the update of the wear ratio threshold value for next parts interchange determination/notification. This is because the image forming apparatus predicts, based on the usage rate, that a change in the wear ratio of the sheet feed roller unit 223D as a counter target for interchange (which is lowest in the wear ratio) will be larger than a change in the wear ratio of the sheet feed roller unit 223B. Thus, the image forming apparatus optimizes timing for parts interchange and reduces work load on the user.

Figures 1, 11:
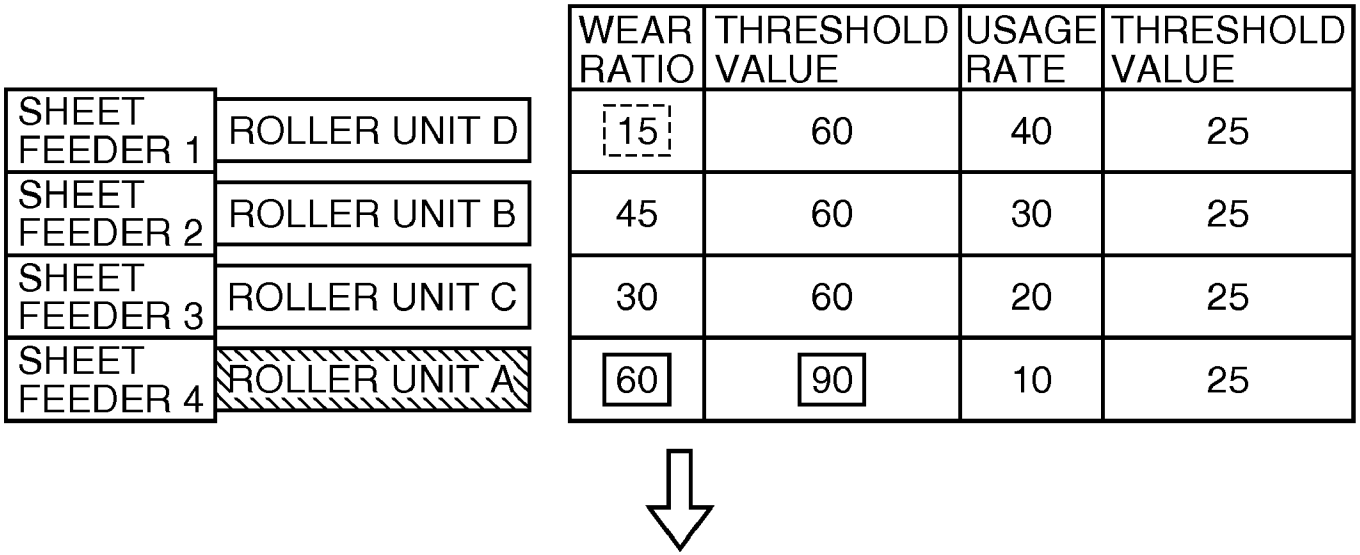
Figures 2, 11:
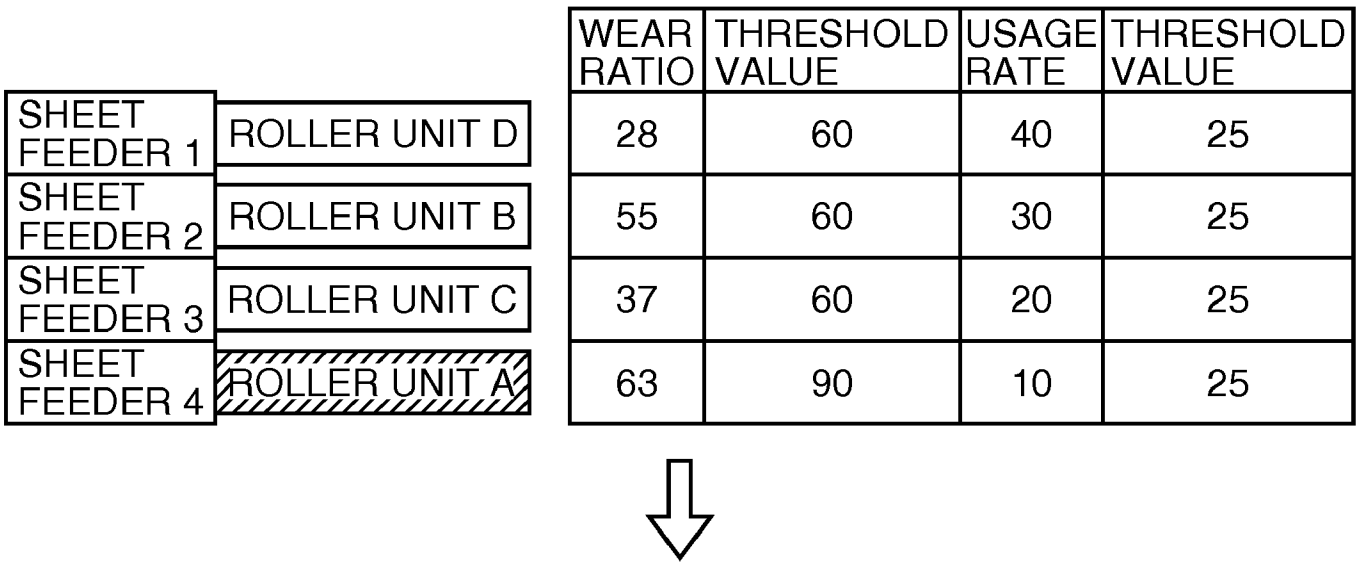
Figures 3, 11:
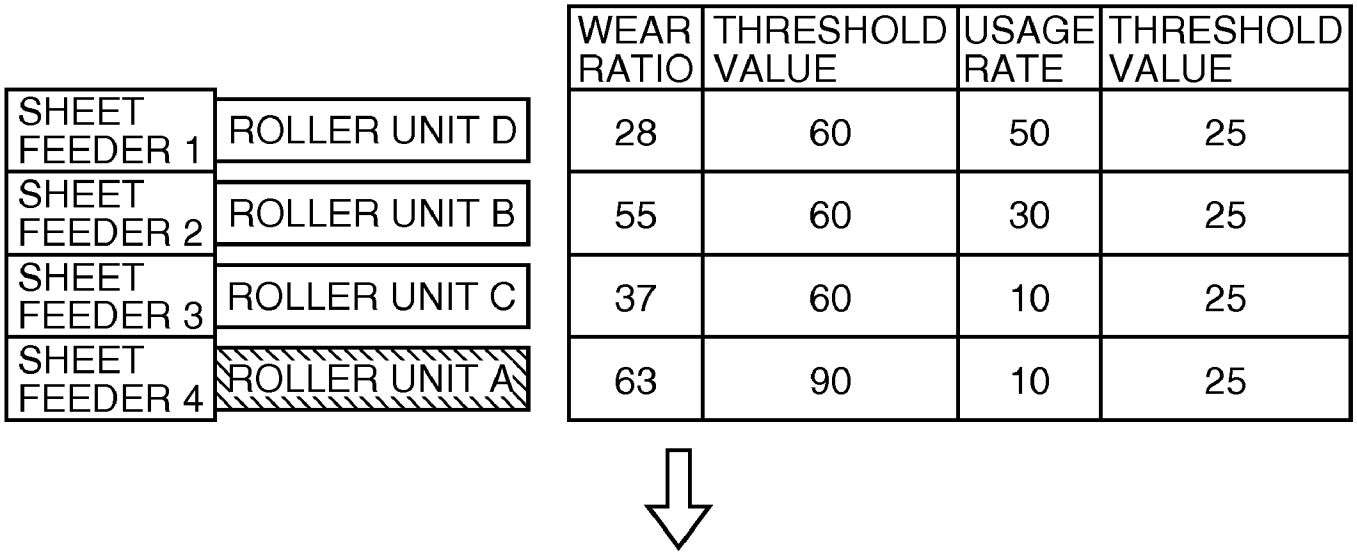
Figures 4, 11:
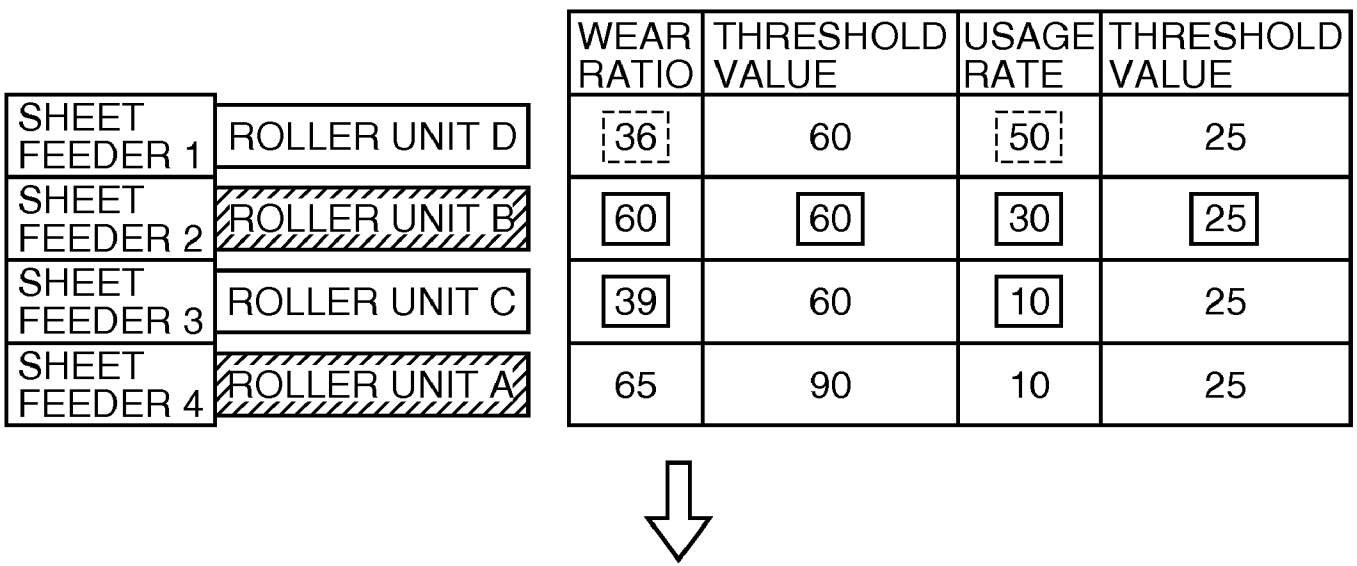

FIGS. 11-1 to 11-5 are diagrams useful in explaining the parts interchange determination 3. The present example shows a case where due to changes in the usage rate, the usage rate of a sheet feeder on an interchange target side is higher than the others. Similarly to the parts interchange determination 2, in the parts interchange determination 3, changes are shown from the state shown in FIG. 8-2, assuming that the settings and usage environment before the state are the same as those in the parts interchange determination 1.

First, when the image forming apparatus continues to be used from the state of the image forming apparatus (more specifically, the states and settings of the sheet feed roller units and associated component parts) shown in FIG. 11-1 corresponding to FIG. 8-2, the wear ratios change e.g. as shown in FIG. 11-2. After the changes in the wear ratios, if the usage rates change such that the frequency of output of A4-size sheets is further increased, the state of the image forming apparatus becomes e.g. as shown in FIG. 11-3. In this state, the usage rates of the respective sheet feeders, i.e. the respective sheet feed cassettes 202A to 202D are changed to 50%, 30%, 10%, and 10%, respectively.

When the image forming apparatus continues to be used from the state in FIG. 11-3, the state of the image forming apparatus becomes e.g. as shown in FIG. 11-4. In this state, the wear ratio of the sheet feed roller unit 223B reaches its threshold value of 60% and the usage rate is equal to 30%, which is higher than the threshold value of 25%. Therefore, the sheet feed roller unit 223B is regarded as a target for parts interchange notification.

On the other hand, in a case where a sheet feed roller unit having the lowest wear ratio is to be selected as a component part for interchange by referring to the wear ratios alone, the sheet feed roller unit 223D should be selected. However, in the parts interchange determination 3, selection is performed as follows: In a state shown in FIG. 11-5, the image forming apparatus operates to select the sheet feed roller unit 223C whose current wear ratio is higher than that of the sheet feed roller unit 223D, by taking the usage rate as well into account.

This is because the image forming apparatus predicts, based on the usage rate, that a change in the wear ratio of the sheet feed roller unit 223C will be smaller than a change in the wear ratio of the sheet feed roller unit 223D. Thus, the image forming apparatus optimizes timing for parts interchange and reduces work load on the user.

As described above, the image forming apparatus as the apparatus according to the present embodiment predicts, based on the usage rates, changes in the wear ratios which provide optimal conditions to be utilized for prolonging the service life of each of the component parts used in the apparatus. Then, when a component part currently in use exceeds the first threshold value, the image forming apparatus determines whether or not it is required to issue a parts interchange notification to the user.

More specifically, in a case where a component part requiring interchange is detected from among a plurality of component parts based on the wear ratios thereof, and the component part requiring interchange is interchanged with another based on the wear ratios of the respective component parts and the usage rates associated with positions of the component parts, the image forming apparatus carries out parts interchange notification to prompt the user to interchange the component part requiring interchange, with the other. The image forming apparatus is thus configured to be capable of defining the optimal conditions for prolonging the service life of each component in use, and issuing a notification to the user when the usage conditions of the apparatus match the optimal conditions, to prompt the user to interchange component parts in use. As a result, it is only required to interchange the component parts, and hence it is possible to expect the user to actively perform maintenance work to thereby realize reduction of service persons' labor. Further, it is possible to balance loads on the component parts used by the image forming apparatus. Therefore, it is possible to substantially prolong the service live of each component part, in terms of a time period over which a user can use without replacement thereof, and prevent the degradation of apparatus specifications before and after parts interchange work by the user.

Further, when a component part requiring interchange is interchanged with another, the threshold value of the wear ratio of the replaced component part is changed to be increased, so that interchange between component parts in use can be carried out a plurality of times before expiration of the service lives of the component parts. This makes it possible to further prolong the service live of each component part, in terms of a time period over which a user can use without replacement thereof.

Furthermore, since information associated with the identifiers of interchanged component parts can be taken over after parts interchange, it is possible to further prevent the degradation of apparatus specifications before and after parts interchange work by the user.

It should be noted that the present invention is not limited to the above-described arrangements of the embodiments, but any suitable arrangement may be employed insofar as it can attain the functions of the embodiment.

For example, although in the above-described embodiment, parts interchange is carried out between the sheet feed roller units 223 as regular consumable parts for feeding recording sheets into the apparatus from the respective sheet feed cassettes 202, the present invention is applicable to a case where parts interchange is carried out between the sheet discharge roller units 224 as regular consumable parts for conveying recording sheets from the fixing unit 210 to the discharge tray 211.

Further, although the image forming apparatus as the apparatus according to the above-described embodiment calculates a wear ratio by incrementing counter information irrespective of the size or sheet type of recording sheets loaded in each of the sheet cassettes 202, this is not limitative, but, for example, a method can be envisaged in which a current wear ratio is calculated by multiplying a counter value by a coefficient dependent on the size and sheet type of recording sheets.

Specifically, in the above-described embodiment, when A4-size sheets are loaded in the first-stage feed cassette and A3-size sheets in the second-stage feed cassette, the threshold value of each wear ratio is calculated assuming that A4-size sheets were output from each feed cassette.

In contrast, in the method in which a current wear ratio is calculated by multiplying a counter value by a coefficient, calculation is performed with reference to an A4 size, and hence when sheets are output from the first-stage feed cassette, the number of the output sheets is multiplied by a coefficient of 1, whereas when sheets are output from the second-stage feed cassette, the number of the output sheets is multiplied by a coefficient of 1.42 using a magnification ratio of A3 with respect to A4. Thus, it is taken into consideration the fact that since the output of an A3-size sheet takes longer sheet conveying time than that of an A4-size sheet, actual wear of a sheet feed roller unit 223 occurring at the time of the A3 output is larger than that occurring at the time of the A4 output.

Similarly, in a case where plain sheets are loaded in the first-stage feed cassette and label sheets in the second-stage feed cassette, in the method in which a current wear ratio is calculated by multiplying a counter value by a coefficient, calculation is performed with reference to the A4 size, and hence when plain sheets are output from the first-stage feed cassette, the number of the output plain sheets is multiplied by a coefficient of 1, whereas when label sheets are output from the second-stage feed cassette, the number of the output sheets is multiplied by a coefficient of 2 using a reciprocal of a throughput reduction rate of a label sheet with respect to a plain sheet. In the case of passing label sheets through the apparatus, throughput is reduced so as to increase image fixability. Thus, due to a longer sheet conveying time which the output of a label sheet takes than the output of a plain sheet having the same size does, it is taken into consideration the fact that actual wear of a sheet feed roller unit 223 is larger when label sheets are output than when plain sheets are output.

Further, although the image forming apparatus as the apparatus according to the above-described embodiment calculates a wear ratio by incrementing the counter value irrespective of the error call history of the apparatus, this is not limitative, but for example, a method can be envisaged in which a current wear ratio is calculated by multiplying the counter value by a coefficient set based on the error call history of the apparatus.

Specifically, when an error, such as a sheet jam, has never been caused by some factor in sheet feed/conveyance from the first-stage feed cassette, the coefficient for use in calculation of a wear ratio is set to 1. On the other hand, when errors, such as sheet jams, have frequently occurred due to some factor in sheet feed/conveyance from the second-stage feed cassette, it is defined that the wear ratio increases by 10% per one feed/conveyance error, and when an error occurs for a first time, the counter value after occurrence of the error is multiplied by 1.1 when calculating the wear ratio. Further, when an error occurs for a second time, it can be considered that the wear ratio increases by 10%×2 (twice), and therefore the counter value after occurrence of the second error are multiplied by "11.2" when calculating the wear ratio.

Further, irrespective of whether one job may be single-page printing or 100-page printing, the image forming apparatus as the apparatus according to the above-described embodiment calculates a wear ratio by incrementing a counter value in the same manner. However, 100-page printing causes a sharper increase in the ambient temperature than single-page printing does, and hence a sheet feed roller unit wears more in 100-page printing. In view of this, for example, a method of calculating the wear ratio of a sheet feed roller unit can be envisaged in which a current wear ratio of the sheet feed roller unit is determined by multiplying the counter value of associated counter information by a coefficient.

Specifically, in a case where printing is performed on e.g. 50 sheets or more over a time period which influences a rise in the ambient temperature, it is defined that when the temperature rises by 10% with respect to a temperature in a standby mode, the wear ratio increases by 20%, and hence the counter value of 51 (sheets) or more is multiplied by 1.2 when calculating the wear ratio.

By executing the above-described methods, changes in the wear ratios of respective component parts of the apparatus can be more accurately predicted while taking into consideration the size and sheet types of recording sheets, the error call history of the apparatus, and a sheet count in continuous printing. Consequently, timing for issuing a parts interchange notification to a user is optimized. More specifically, since the wear ratios are corrected according to a sheet size, a sheet type, error call history, a sheet count in continuous printing, etc., it is possible to more accurately define conditions for determining necessity of interchange between component parts in use by a parts interchange determining unit for. This makes it possible to optimize timing for issuing a parts interchange notification to a user and reduce work load on the user.

Further, the image forming apparatus of the present invention is applicable to a printing apparatus, a facsimile machine equipped with a print function, a multi-function peripheral (MFP) equipped with a print function, a copy function, and a scanner function, and so forth.

In the above-described embodiment, the image forming apparatus uses the photosensitive drums associated with the respective colors Y, M, C, and K, and sequentially transfers Y, M, C, and K toner images carried on the respective photosensitive drums onto a recording sheet in superimposed relation. However, a transfer method is not limited to this, but an image forming apparatus may employ a transfer method using an intermediate transfer member, in which toner images in the respective colors are sequentially transferred onto the intermediate transfer member in superimposed relation, followed by a full-color toner image carried by the intermediate transfer member being transferred onto a recording sheet in a single operation.

Furthermore, the shapes and relative positions of the component parts described in the above-described embodiment can be changed, as deemed appropriate, according to the arrangement of an apparatus to which the present invention is applied, and various conditions, and therefore it is to be understood that the present invention is by no means limited to the disclosed exemplary embodiment.

Although in the above-described embodiment, the electrophotographic printing is adopted as the printing method executed by the MFP, there is no intention to limit the invention to this, but the present invention may be applied to a variety of printing methods such as ink-jet printing, thermal transfer printing, thermal printing, electrostatic printing, and discharge breakdown printing.

Further, the image forming apparatus may be connected to various optional devices (also called accessories) that expand the functions of the image forming apparatus, as desired, according to the user's demand. For example, as the optional device, there may be mentioned a large-capacity paper deck capable of feeding or conveying a large number of sheets, and a stapler for stapling sheets having respective images formed thereon. Further, there may be mentioned a folder for folding sheets and a sorter for sorting sheets. Further, there may be mentioned a puncher for punching holes for filing in sheets, and an automatic double-sided sheet feeder for forming images on both sides of each sheet. Further, there may be mentioned an interleaving device for inserting another sheet between sheets, and a cutting device capable of cutting a large number of sheets simultaneously. Further, there may be mentioned an automatic document feeder for automatically feeding originals to a scanner, and a fixing and post-processing device for processing output images into higher-quality images. The present invention can also be applied to interchange between component parts mounted in each of the above-mentioned optional devices.

Further, a sheet (recording sheet) is not particularly limited, but a paper medium, an OHP sheet, a thick sheet may be used.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2008-128316 filed May 15, 2008, which is hereby incorporated by reference herein in its entirety.

What is claimed is:

1. An apparatus having a plurality of component parts interchangeably disposed in a plurality of component positions, respectively, comprising:

a judgment unit configured to judge whether or not to carry out interchange between a component position of a first component part and a component position of a second component part, based on wear ratios of the respective component parts and usage rates associated with the respective component positions; and a notification unit configured to be operable when it is judged by said judgment unit that the interchange between the component position of the first component part and the component position of the second component part is to be carried out, to perform notification for prompting a user to carry out the interchange;

wherein when a wear ratio of the first component part exceeds a first threshold value, and at the same time, a usage rate associated with a component position where the first component part is disposed exceeds a second threshold value, said judgment unit judges that the first component part is a component part requiring interchange, the apparatus further comprising:

an update unit configured to be operable when the interchange between the component position of the first component part and the component position of the second component part is carried out, to update the first threshold value associated with the first component part such that the first threshold value is increased.

2. An apparatus having a plurality of component parts interchangeably disposed in a plurality of component positions, respectively, comprising:

a judgment unit configured to judge whether or not to carry out interchange between a component position of a first component part and a component position of a second component part, based on wear ratios of the respective component parts and usage rates associated with the respective component positions;

a notification unit configured to be operable when it is judged by said judgment unit that the interchange between the component position of the first component part and the component position of the second component part is to be carried out, to perform notification for prompting a user to carry out the interchange; and a correction unit configured to correct the wear ratios of the component parts.

3. An apparatus having a plurality of component parts interchangeably disposed in a plurality of component positions, respectively, comprising:

a judgment unit configured to judge whether or not to carry out interchange between a component position of a first component part and a component position of a second component part, based on wear ratios of the respective component parts and usage rates associated with the respective component positions;

a notification unit configured to be operable when it is judged by said judgment unit that the interchange between the component position of the first component part and the component position of the second component part is to be carried out, to perform notification for prompting a user to carry out the interchange;

unique identifiers assigned to the respective component parts;

a determining unit configured to determine that interchange of component parts has been carried out when a correspondence between the identifiers of the respective component parts and the component positions is changed;

an interchange unit configured to be operable when it is determined by said determining unit that the interchange between the component parts has been carried out, and at the same time, the identifiers of the component parts subjected to the interchange are detected from among the identifiers of the respective component parts, to determine that interchange of component positions is carried out between the component parts, and interchange pieces of information on the identifiers according to the interchanged component positions; and an initialization unit configured to be operable when it is determined by said determining unit that the interchange of the component parts has been carried out and at the same time, no identifiers of the component parts subjected to the interchange are detected from among the identifiers of the respective component parts, to determine that at least one of the component parts has been replaced with a new component part other than the component parts, and initialize information associated with an identifier of the new component part.

4. An apparatus having a plurality of component parts interchangeably disposed in a plurality of component positions, respectively, and unique identifiers assigned to the respective component parts, comprising:

a determining unit configured to determine that interchange of component parts has been carried out when a correspondence between the identifiers of the respective component parts and the component positions is changed;

an interchange unit configured to be operable when it is determined by said determining unit that the interchange between the component parts has been carried out, and at the same time, the identifiers of the component parts subjected to the interchange are detected from among the identifiers of the respective component parts, to determine that interchange of component positions is carried out between the component parts, and interchange pieces of information on the identifiers according to the interchanged component positions;

an initialization unit configured to be operable when it is determined by said determining unit that the interchange of the component parts has been carried out and at the same time, no identifiers of the component parts subjected to the interchange are detected from among the identifiers of the respective component parts, to determine that at least one of the component parts has been replaced with a new component part other than the component parts, and initialize information associated with an identifier of the new component part; and a correction unit configured to correct the wear ratios of the component parts.

5. A method of controlling parts interchange in an apparatus having a plurality of component parts interchangeably disposed in a plurality of component positions, respectively, comprising:

determining whether or not to carry out interchange between a component position of a first component part and a component position of a second component part, based on wear ratios of the respective component parts and usage rates associated with the respective component positions;

performing notification for prompting a user to carry out the interchange, when it is determined that the interchange between the component position of the first component part and the component position of the second component part is to be carried out; and correcting the wear ratios of the component parts.

6. A method of controlling parts interchange in an apparatus having a plurality of component parts interchangeably disposed in a plurality of component positions, respectively, and unique identifiers assigned to the respective component parts, comprising:

determining that interchange of component parts has been carried out when a correspondence between the identifiers of the respective component parts and the component positions is changed;

determining, when it is determined that the interchange between the component parts has been carried out, and at the same time, the identifiers of the component parts subjected to the interchange are detected from among the identifiers of the respective component parts, that interchange of component positions is carried out between the component parts, and interchanging pieces of information on the identifiers according to the interchanged component positions;

determining, when it is determined that the interchange of the component parts has been carried out and at the same time, no identifiers of the component parts subjected to the interchange are detected from among the identifiers of the respective component parts, that at least one of the component parts has been replaced with a new component part other than the component parts, and initializing information associated with an identifier of the new component part; and correcting the wear ratios of the component parts.

7. An apparatus having a plurality of component parts disposed in respective positions, comprising:

a judgment unit configured to judge, based on a wear condition of a first component part of the plurality of component parts and a usage condition of a position where the first component part is mounted, whether or not to move the first component part from the position thereof;

a notification unit configured to be operable when it is judged by said judgment unit that the first component part is to be moved from the position thereof, to perform notification for prompting a user to move the first component part to a position where a second component part of the plurality of component parts is mounted; and a correction unit configured to correct the wear ratios of the component parts.

8. A method of controlling parts interchange in an apparatus having a plurality of component parts disposed in respective positions, comprising:

judging, based on a wear condition of a first component part of the plurality of component parts and a usage condition of a position where the first component part is mounted, whether or not to move the first component part from the position thereof; and performing notification for prompting a user to move the first component part to a position where a second component part of the plurality of component parts is mounted, when it is judged that the first component part is to be moved from the position thereof; and correcting the wear ratios of the component parts.

* * * * *